US008334739B2

(12) United States Patent
Wan et al.

(10) Patent No.: US 8,334,739 B2
(45) Date of Patent: Dec. 18, 2012

(54) CIRCUIT BREAKER WITH SHORT CIRCUIT SELF-LOCKING FUNCTION

(75) Inventors: Jiasheng Wan, Wuhan (CN); Zhiqiang Wang, Wuhan (CN)

(73) Assignee: Jiasheng Wan, Wuhan (CN)

( * ) Notice: Subject to any disclaimer, the term of this patent is extended or adjusted under 35 U.S.C. 154(b) by 34 days.

(21) Appl. No.: 12/845,783

(22) Filed: Jul. 29, 2010

(65) Prior Publication Data

US 2011/0089006 A1 Apr. 21, 2011

Related U.S. Application Data

(63) Continuation of application No. PCT/CN2009/070833, filed on Mar. 17, 2009.

(30) Foreign Application Priority Data

| | | |
|---|---|---|
| Jul. 4, 2008 | (CN) | 2008 1 0048307 |
| Aug. 7, 2008 | (CN) | 2008 1 0146079 |
| Aug. 18, 2008 | (CN) | 2008 1 0048848 |
| Feb. 12, 2009 | (CN) | 2009 1 0060727 |

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 9/00*** | (2006.01) |

(52) U.S. Cl. ..... 335/172; 335/6

(58) Field of Classification Search ..... 335/6, 167–176
See application file for complete search history.

(56) References Cited

U.S. PATENT DOCUMENTS

| | | | | |
|---|---|---|---|---|
| 4,931,757 | A * | 6/1990 | Lemmer et al. | 335/131 |
| 5,508,670 | A * | 4/1996 | Mantzouridis et al. | 335/172 |
| 6,714,108 | B1 * | 3/2004 | Simms et al. | 335/6 |
| 7,113,062 | B2 * | 9/2006 | Girot et al. | 335/6 |
| 7,405,640 | B2 * | 7/2008 | McCoy | 335/6 |
| 7,414,498 | B2 * | 8/2008 | McCoy | 335/6 |
| 2006/0061439 | A1 * | 3/2006 | Schalk et al. | 335/6 |
| 2006/0097829 | A1 * | 5/2006 | McCoy | 335/6 |

* cited by examiner

*Primary Examiner* — Elvin G Enad
*Assistant Examiner* — Alexander Talpalatski
(74) *Attorney, Agent, or Firm* — Matthias Scholl P.C.; Matthias Scholl

(57) ABSTRACT

A circuit breaker with a short circuit self-locking function, a short circuit self-locking mechanism is disposed in the circuit breaker, and comprises a self-locking mechanism and a reset mechanism. As the circuit breaker is opened, it cannot be directly closed, whereby reminding an operator of a short circuit fault.

1 Claim, 45 Drawing Sheets

CIRCUIT BREAKER WITH SHORT CIRCUIT SELF-LOCKING FUNCTION

CROSS-REFERENCE TO RELATED APPLICATIONS

This application is a continuation of International Patent Application No. PCT/CN2009/070833 with an international filing date of Mar. 17, 2009, designating the United States, now pending, and further claims priority benefits to Chinese Patent Application No. 200810048307.3 filed Jul. 4, 2008; Chinese Patent Application No. 200810146079.3 filed Aug. 7, 2008; Chinese Patent Application No. 200810048848.6 filed Aug. 18, 2008; and Chinese Patent Application No. 200910060727.8 filed Feb. 12, 2009. The contents of all of the aforementioned applications, including any intervening amendments thereto, are incorporated herein by reference.

BACKGROUND OF THE INVENTION

1. Field of the Invention

The present invention relates to a low voltage electric appliance, and more particularly to a circuit breaker with a short circuit self-locking function.

2. Description of the Related Art

A circuit breaker, also named an air breaker switch, is composed essentially of a housing, a handle, a self-locking linkage, a tripping linkage, an actuating arm, and a movable contact (see FIG. 1). The work process of this air breaker switch is as described below. The handle controls the self-locking linkage, which causes the actuating arm to move such that the movable contact is forced to abut a metal sheet, thereby closing the circuit. In parallel, the self-locking linkage engages the tripping linkage to achieve self-locking in a closed state (see FIG. 2). To protect the circuit, the prior circuit breaker also has a short circuit actuating mechanism and a bimetal strip protection mechanism provided therein. When the current flowing in the circuit breaker is higher than rated current, usually ten times the assigned current, then a short circuit has occurred. As a consequence, an overcurrent coil of the short circuit actuating mechanism activates a mechanism that drives a actuating arm of the short circuit actuating mechanism to push a lower end of the tripping linkage, which triggers the tripping linkage to pivot such that the self-locking linkage disengages from the tripping linkage, thereby opening the circuit and achieving protection. The work process of the bimetal strip is as follows. When the current flowing in the circuit breaker is higher than the rated current, usually two times the assigned current, the bimetal strip deflects and triggers the tripping linkage to pivot such that the self-locking linkage disengages from the tripping linkage, thereby breaking the circuit and achieving protection. However, the actuating arm of the short circuit actuating mechanism and the bimetal strip will restore their initial states after the circuit breaker has tripped. The above circuit breaker protects the circuit upon occurrence of a short circuit, but a drawback of the design is that the circuit breaker can close again without identifying the reason why the circuit breaker is opened. The operator does not know whether the circuit breaker tripped due to protect against an overcurrent or short circuit. The cause of the accident may persist and worsen, potentially impacting the electrical grid or starting a fire. Such accidents have been reported many times.

SUMMARY OF THE INVENTION

An object of the present invention is to provide a circuit breaker that self-locks upon occurrence of a short circuit and that cannot be reclosed until it is reset after the circuit breaker trips upon occurrence of short circuit. The resulting manual reset reminds the operator that a short circuit has occurred, which overcomes the drawbacks in the prior art that the cause of the accident may persist or worsen, potentially impacting the electrical grid or starting a fire.

To achieve the above object, the present invention provides a short circuit self-locking mechanism provided in a circuit breaker.

The short circuit self-locking mechanism comprises a self-locking mechanism operating to keep a tripping linkage at a short circuit protection state, and a reset mechanism operating to force the tripping linkage to restore an initial state thereof.

The short circuit self-locking mechanism comprises a self-locking mechanism operating to force and maintain a actuating arm of the short circuit actuating mechanism to push the tripping linkage, and a reset mechanism operating to force the actuating arm of the short circuit actuating mechanism to restore an initial state thereof.

Because the circuit breaker according to the present invention has a short circuit self-locking mechanism provided therein, the circuit breaker cannot be closed directly after the circuit breaker trips upon occurrence of a short circuit, which serves to remind the operator that a short circuit has occurred and the circuit breaker should be re-closed after the problem is identified and resolved. The present invention not only maintains all of the functions of the conventional circuit breaker, but also adds a self-locking function upon occurrence of a short circuit so as to overcome the shortcoming of the prior art that the automatically re-closing of the circuit breaker allows damage in the circuit to persist or worsen, potentially starting a fire if the circuit breaker re-closes after short circuit.

010—a housing, 020—a handle, 030—a self-locking linkage, 040—a tripping linkage, 050—a short circuit self-locking mechanism, 051—a actuating arm, 060—a bimetal strip, 070—a actuating arm, 080—a movable contact, 090—a button, 091—a convex block, 092—a long plate, 093—a bolt, 100—a rotating rod, 101—a groove, 110—a lever, 120—a magnetic metal, 130—an electromagnet, 131—an actuating arm, 140—a reed pipe, 150—a transformer, 160—a control circuit, 170—a long rod, 180—a long plate, 181—a protruding point, 190—An extension rod, 191—a groove in the extension rod, 200—a pivoting shaft, 210—a rotating plate, 220—a trigger arm, 230—an inner lead, 240—a magnetic shelf, 250—a spring, 260—a supporting frame, 270—a rotating arm, 271—a protruding edge, 280—a torsion spring, 290—a limit block, 300—a rotating sleeve, 301—an spiral groove, 302—a protruding portion of a rotating sleeve, 310—an outer sleeve, 311—an protruding portion of an outer sleeve, 320—a movable block, 321—a groove, 322—an outer protruding edge, 330—an extension spring, 340—a compression spring.

DETAILED DESCRIPTION OF THE EMBODIMENTS

Further description will be given below in conjunction with accompanying drawings and specific embodiments.

The present invention maintains the structure and all of the functions of the original circuit breaker and additionally has a short circuit self-locking mechanism provided therein, the short circuit self-locking mechanism comprises a self-locking mechanism operating to keep a tripping linkage in a short circuit protection state and a reset mechanism operating to force the tripping linkage to restore an initial state thereof.

Embodiment 1

Figure 1:
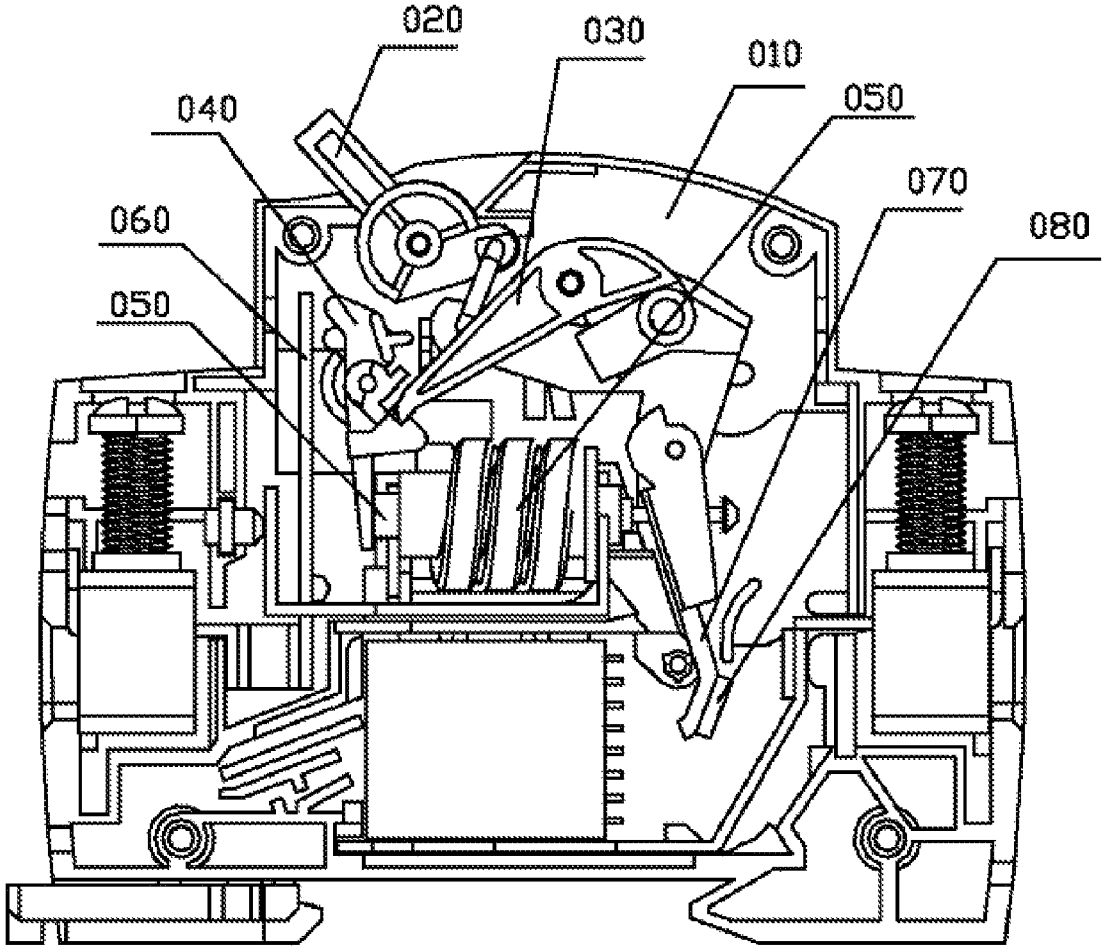
Prior Art FIG. 1
FIG. 1 is a schematic view of a conventional circuit breaker in an open state.
Figure 2:
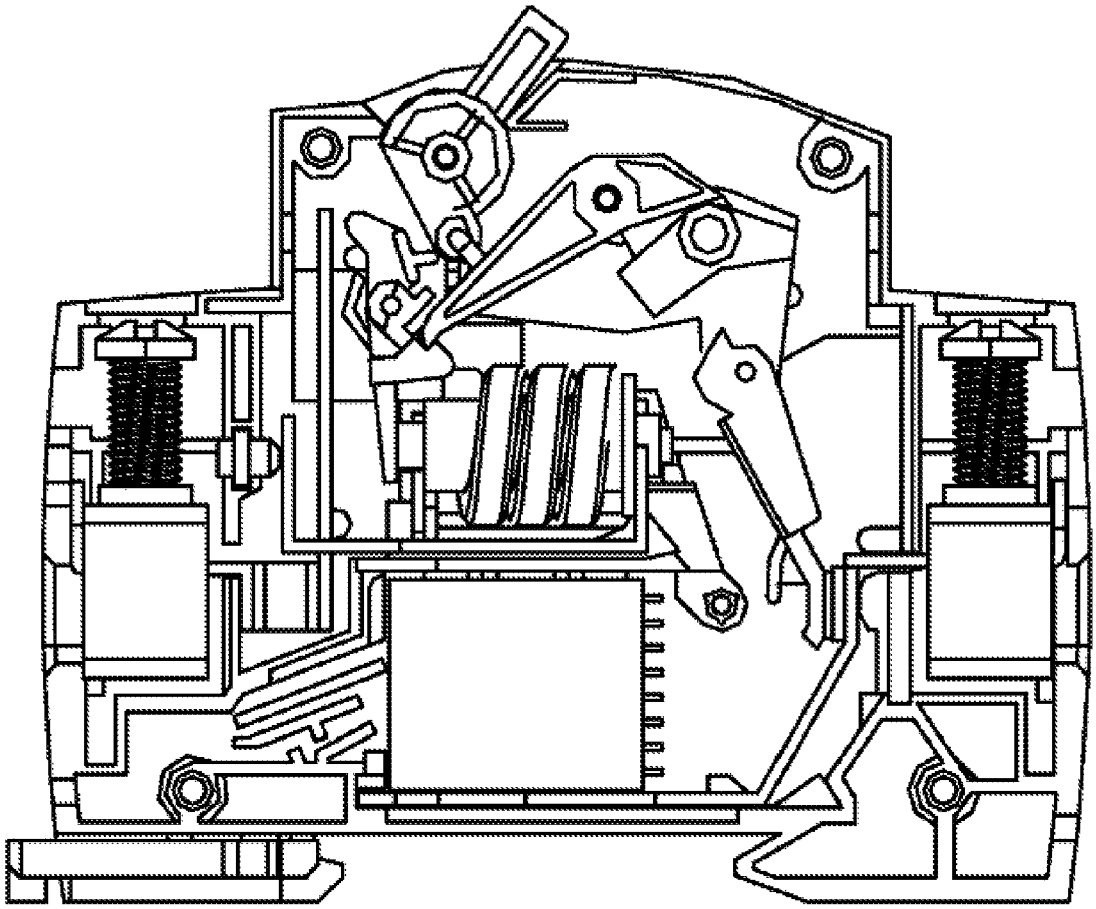
Prior Art FIG. 2
FIG. 2 is a schematic view of the conventional circuit breaker in a closed state.
Figure 3:
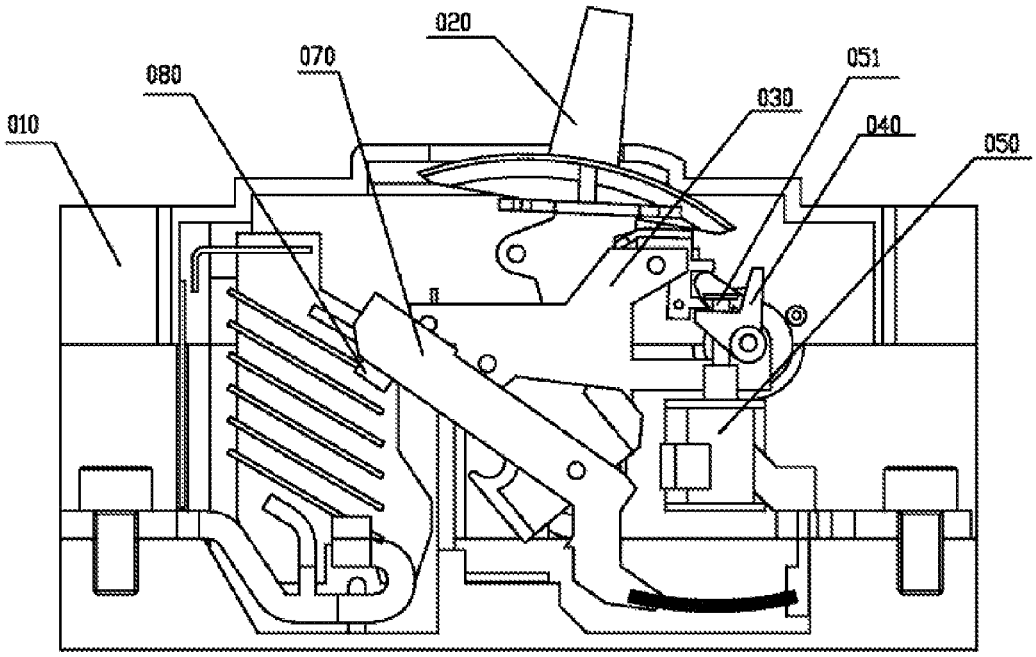
Prior Art FIG. 3
FIG. 3 is a schematic view of a conventional three-phase moulded case circuit breaker in an open state.
Figure 4:
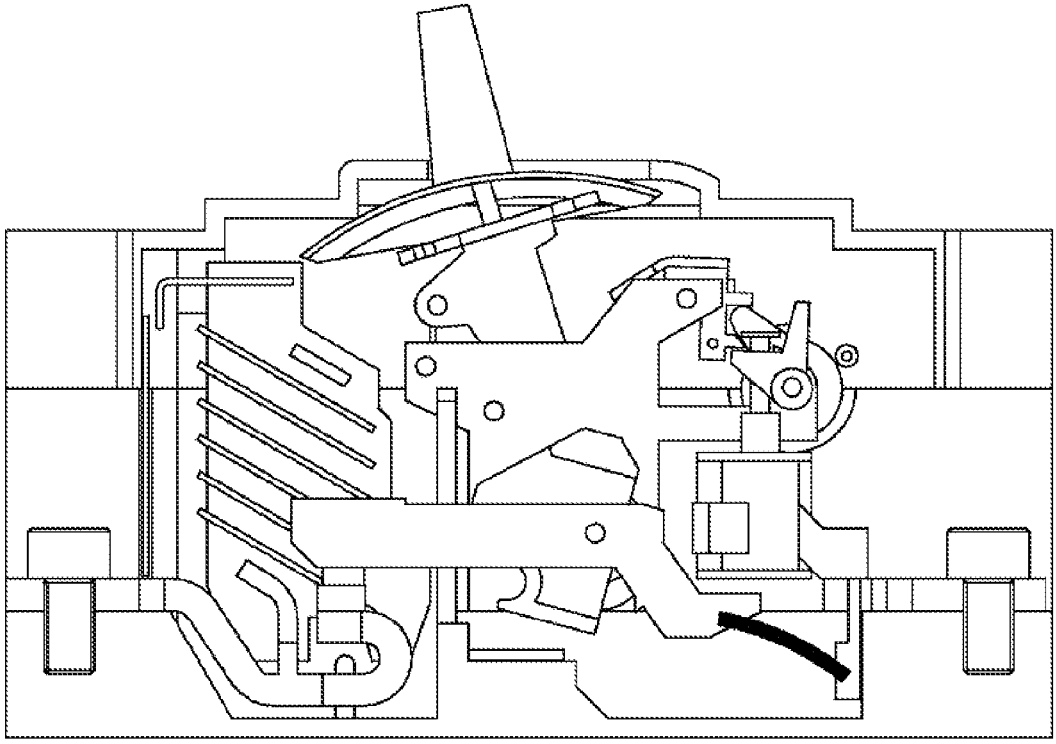
Prior Art FIG. 4
FIG. 4 is a schematic view of the conventional three-phase moulded case circuit breaker in a closed state.
Figure 5:
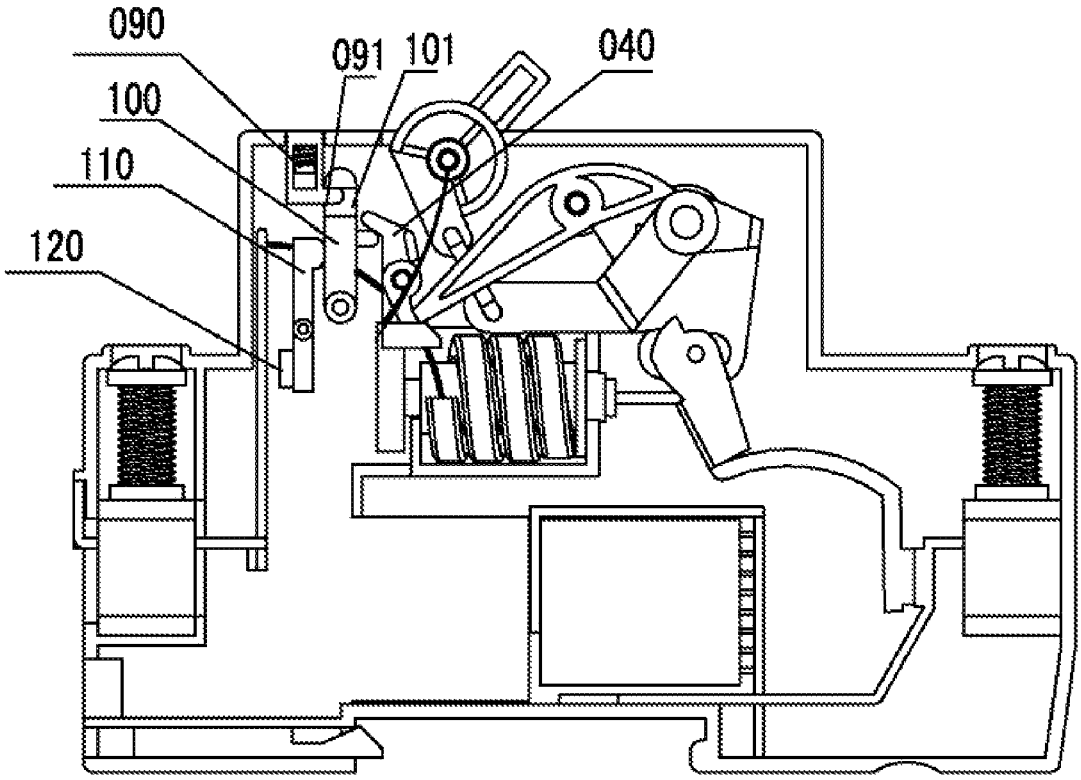
FIG. 5 is a schematic view of Embodiment 1 according to the present invention in a closed state.

The self-locking mechanism comprises a lever with a magnetic metal being disposed at a lower end thereof, and a rotating rod with a lower end being hinged on a housing of the circuit breaker, the reset mechanism is formed by a button having a compression spring being disposed therein and engaged with the rotating rod, the lever is disposed in the vicinity of a bimetal strip of the circuit breaker, a middle portion of the lever is hinged on the housing of the circuit breaker, an upper portion of the lever is contacted with an edge of the top of a hinged point of the rotating rod, the other edge of the rotating rod is contacted with an upper portion of the tripping linkage in the circuit breaker, a groove is disposed on an upper portion of the rotating rod, a convex block is disposed at the lower portion of a button, as the compression spring in the button is compressed, the convex block at the lower portion of the button is disposed in the groove on the upper portion of the rotating rod, see FIG. 5.

Figure 6:
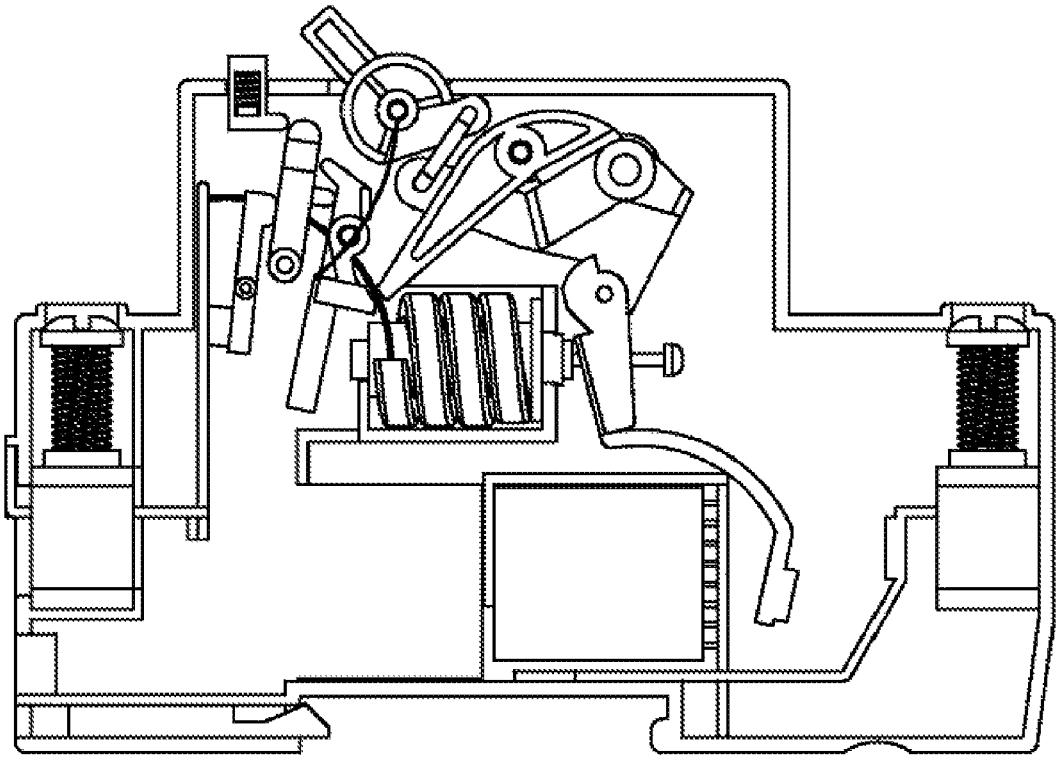
FIG. 6 is a schematic view of Embodiment 1 according to the present invention in a self-locking state.

Operation principle of this embodiment is as described below. When short circuit occurs, the current flowing in the bimetal strip is much higher than the rated current of the circuit breaker. A strong magnetic field is generated around the bimetal strip, which attracts the magnetic metal disposed at the lower end of the lever so as to cause the lever to rotate. (If an overcurrent occurs, the magnetic field generated around the bimetal strip is not strong enough to attract the magnetic metal disposed at the lower end of the lever.) The upper portion of the lever pushes the rotating rod and causes it to rotate, and in turn triggers the tripping linkage to rotate, which cooperates with the short circuit self-locking mechanism to open the circuit breaker. At the same time, the rotation of the rotating rod forces the convex block at the lower portion of the button to disengage from the groove in the upper portion of the rotating rod, which causes restoration of the compression spring. The convex block at the lower portion of the button moves upwardly with the button then abuts one side of the rotating rod, as shown in FIG. 6. Thus, the lever returns to its initial position, but the rotating rod cannot restore its initial position after the circuit breaker trips. That is to say, the upper portion of the rotating rod maintains the tripping linkage in a tripped state such that the circuit breaker cannot be closed, even if the handle is closed, which achieves self-locking upon occurrence of short circuit. Resetting is accomplished by pressing the button to cause the convex block at the lower end of the button to be positioned in the groove in the upper portion of the rotating rod, which restores the position of the rotating rod, and in turn the trip link such that the circuit breaker can be closed by closing the handle again.

Embodiment 2

Figure 7:
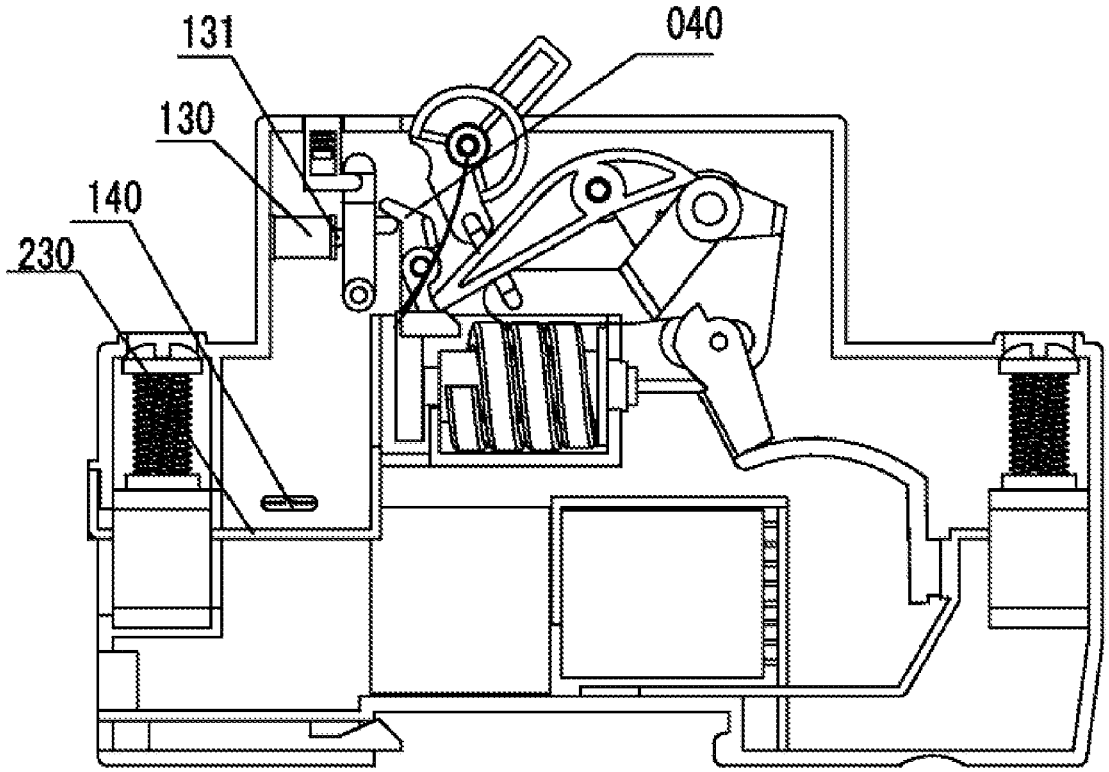
FIG. 7 is a schematic view of Embodiment 2 according to the present invention in a closed state.

The self-locking mechanism comprises an electromagnet and a reed pipe disposed in the housing of the circuit breaker, and a rotating rod with a lower end being hinged in the housing of the circuit breaker, the reset mechanism is the same as embodiment 1, the reed pipe is disposed in the vicinity of an inner lead of the circuit breaker, the electromagnet is disposed in the vicinity of the rotating rod, a coil of the electromagnet is serially connected with the reed pipe and then with a power supply input to the circuit breaker, a actuating arm of the electromagnet is contacted with an edge of the top of a hinged point of the rotating rod, and the other structure is the same as embodiment 1 (FIG. 7).

Figure 8:
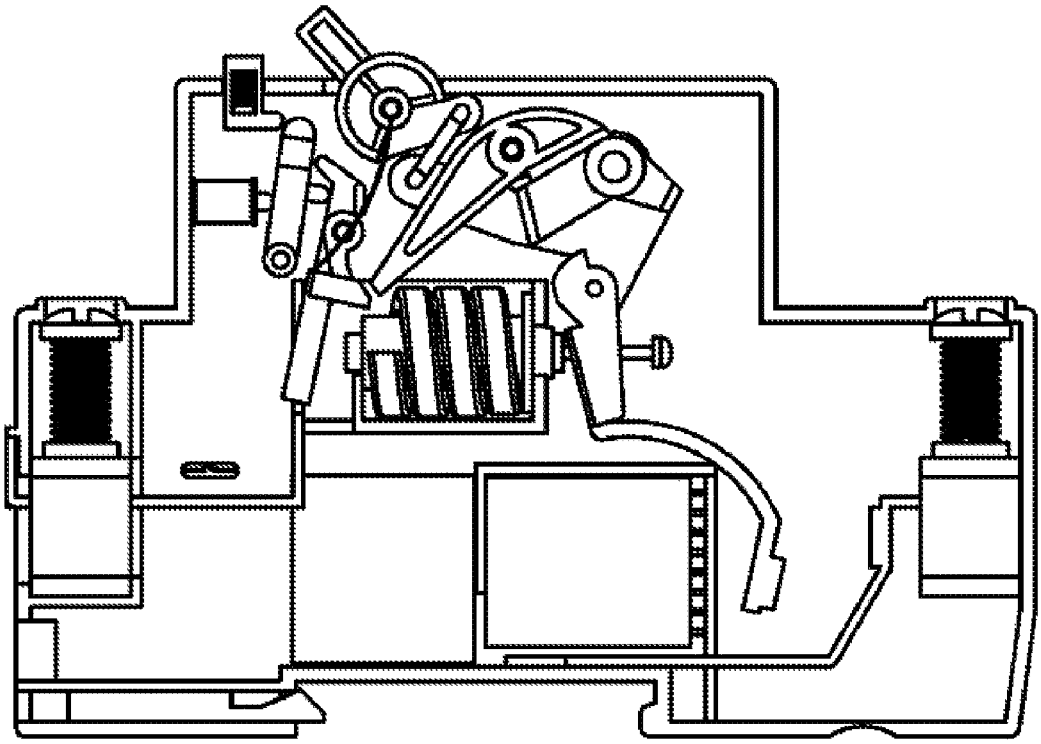
FIG. 8 is a schematic view of Embodiment 2 according to the present invention in a self-locking state.

Operation principle of this embodiment is as described below. When short circuit occurs, the current flowing in the inner leads of the circuit breaker is much higher than the rated current of the circuit breaker. A strong magnetic field is generated around the inner leads, which attracts the reed pipe. The electricity is applied to the coil of the electromagnet, and the actuating arm moves to push the rotating rod to rotate, thereby pushing the tripping linkage to rotate, see FIG. 8. Other principles are the same as those described in Embodiment 1.

Embodiment 3

Figure 9:
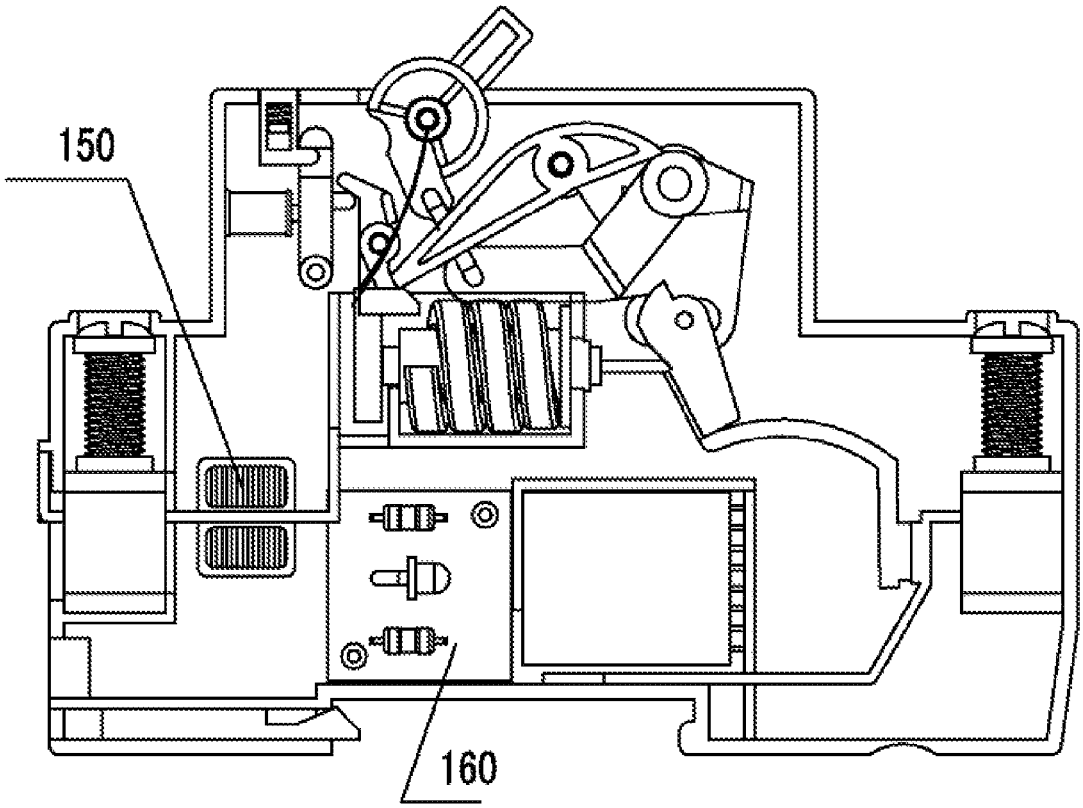
FIG. 9 is a schematic view of Embodiment 3 according to the present invention in a closed state.

The self-locking mechanism comprises an electromagnet disposed in the housing of the circuit breaker, a transformer, and a rotating rod with a lower end being hinged in the housing of the circuit breaker, the reset mechanism is the same as Embodiment 1, the lead in the circuit breaker passes through the transformer, an output of the transformer is connected with a control circuit, the control circuit controls movement of the electromagnet, the electromagnet is located in the vicinity of the rotating rod, and the other structure is the same as Embodiment 1 (FIG. 9).

Figure 10:
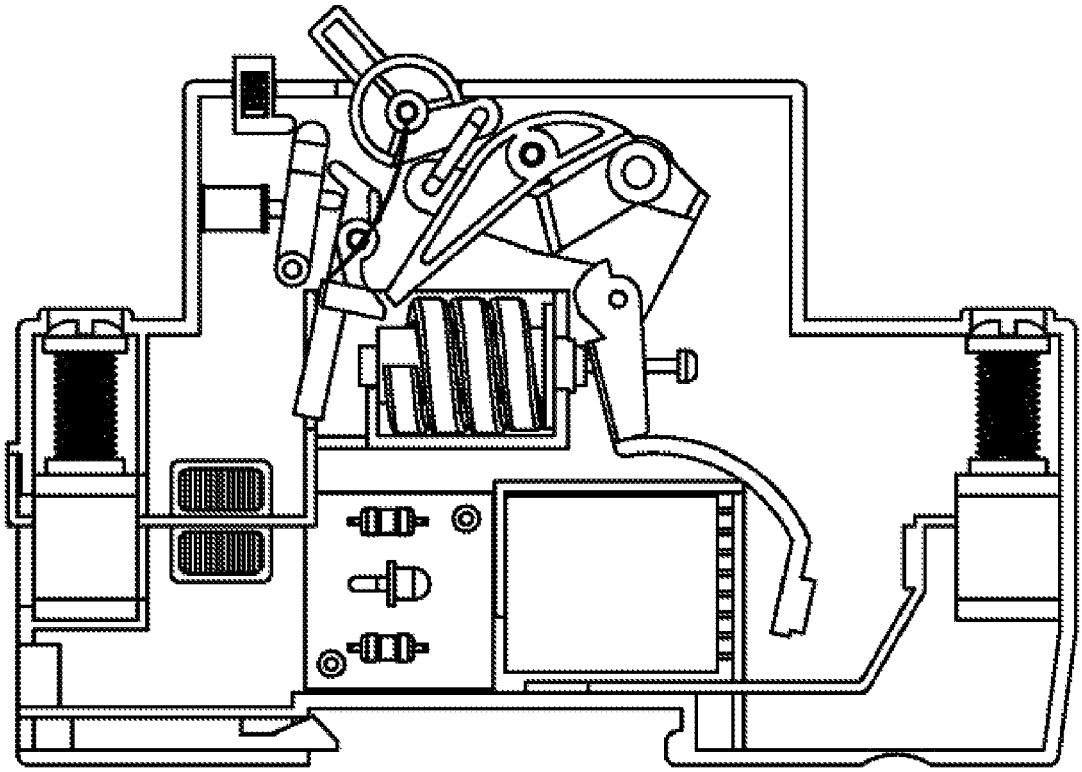
FIG. 10 is a schematic view of Embodiment 3 according to the present invention in a self-locking state.
Figure 11:
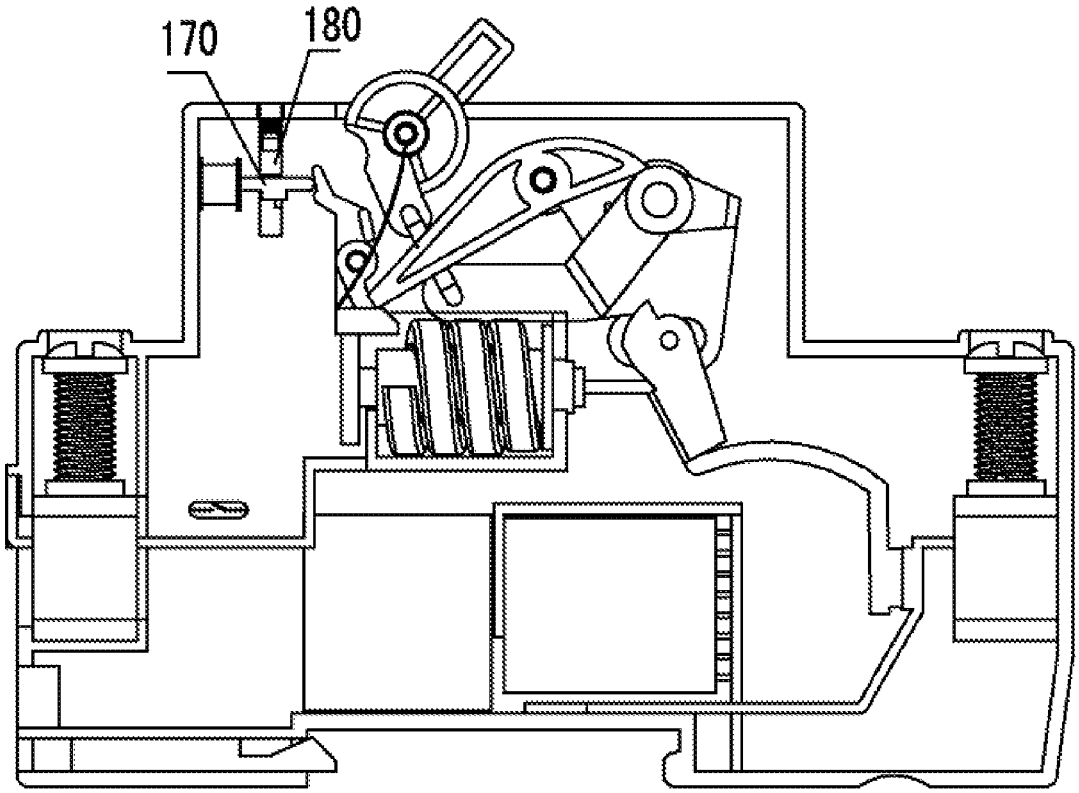
FIG. 11 is a schematic view of Embodiment 4 according to the present invention in a closed state.

Operation principle of this embodiment is as described below. When short circuit occurs, the current flowing in the inner leads of the circuit breaker is much higher than the rated current of the circuit breaker. The transformer outputs a current signal to the control circuit, and the control circuit drives the coil of the electromagnet to conduct such that the actuating arm moves to push the rotating rod to rotate, thereby pushing the tripping linkage to rotate, see FIG. 10. Other principles are the same as those described in Embodiment 1.

Embodiment 4

The self-locking mechanism comprises an electromagnet and a reed pipe disposed in the housing of the circuit breaker, a long rod with a convex edge is connected with the actuating arm of the electromagnet, an end of the long rod is contacted with an upper portion of the tripping linkage in the circuit breaker; the reset mechanism is formed by a button having a compression spring being disposed therein and engaged with the long rod, an inner end of the button is connected with a long plate with a stepped groove, the long plate is disposed between the electromagnet and the tripping link, a portion of the stepped groove in the long plate in the vicinity of the electromagnet is a shallow groove, and a portion of the stepped groove in the vicinity of the tripping linkage is a deep groove, as the compression spring in the button is compressed, the convex edge of the long rod is disposed in the shallow groove, the reed pipe is disposed in the vicinity of the lead in the circuit breaker, a coil of the electromagnet is serially connected with the reed pipe and then with an power supply input to the circuit breaker.

Figure 12:
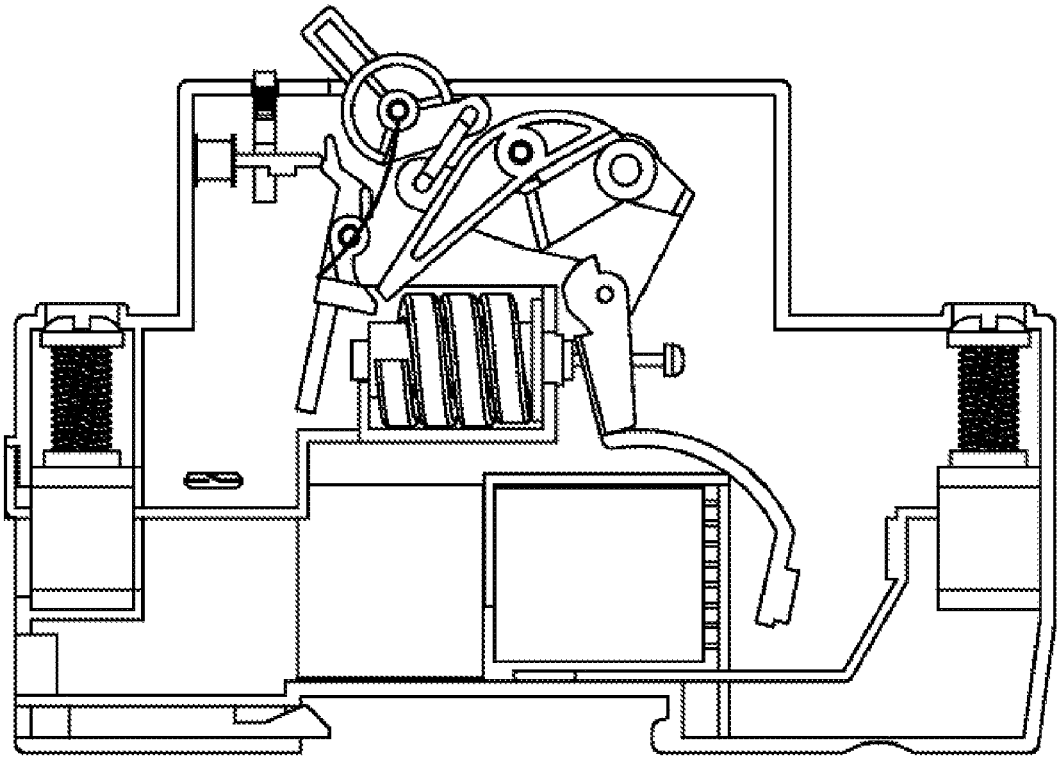
FIG. 12 is a schematic view of Embodiment 4 according to the present invention in a self-locking state.

Operation principle of this embodiment is as described below. When short circuit occurs, the current flowing in the inner leads of the circuit breaker is much higher than the rated current of the circuit breaker. A strong magnetic field is generated around the inner leads, which causes an attraction of the reed pipe. The electricity is applied to the coil of the electromagnet, and the actuating arm moves to push the rotating rod to rotate, thereby pushing the tripping linkage to rotate, which cooperates with the short circuit self-locking mechanism to open the circuit breaker. At the same time, the movement of the long rod and the restoration of the compression spring in the button force the convex edge of the long rod to move from the shallow groove of the stepped groove to the deep groove of the stepped groove of the long plate. The convex edge of the long rod is engaged with the deep groove of the stepped groove and cannot restore its former position. The tripping linkage is maintained in a tripped state such that the circuit breaker cannot be closed even if the handle is closed, which achieves self-locking upon occurrence of a short circuit, as shown in FIG. 12. Resetting is accomplished by pressing the button, which allows the actuating arm to restore and the convex edge of the long rod to disengage from the deep groove of the stepped groove in the long plate and to relocate to the shallow groove of the stepped groove in the long plate. After the trip link is restored, the circuit breaker can be closed by closing the handle again.

Embodiment 5

Figure 13:
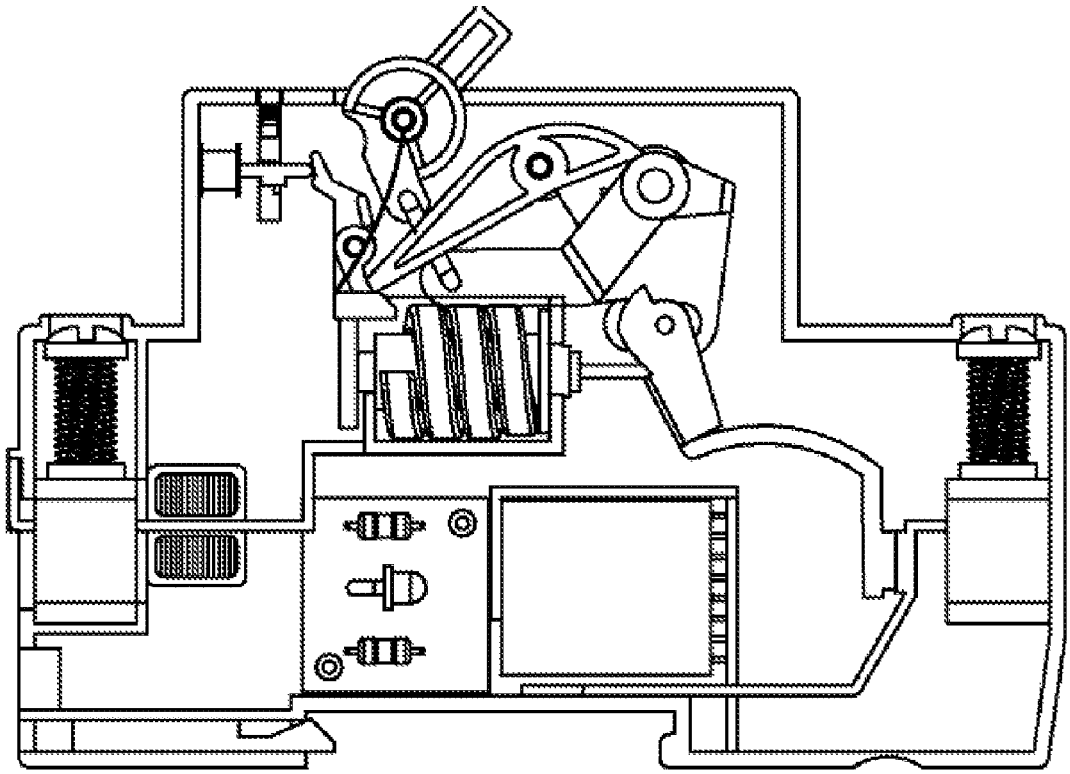
FIG. 13 is a schematic view of Embodiment 5 according to the present invention in a closed state.

The self-locking mechanism of the present invention comprises an electromagnet, a transformer, and a control circuit all disposed in the housing of the circuit breaker. The inner leads of the circuit breaker pass through the transformer, the output end of the transformer is connected with a control circuit for controlling the movement of the electromagnet, see FIG. 40. Other structures are the same as those described in Embodiment 4, see FIG. 13.

Figure 14:
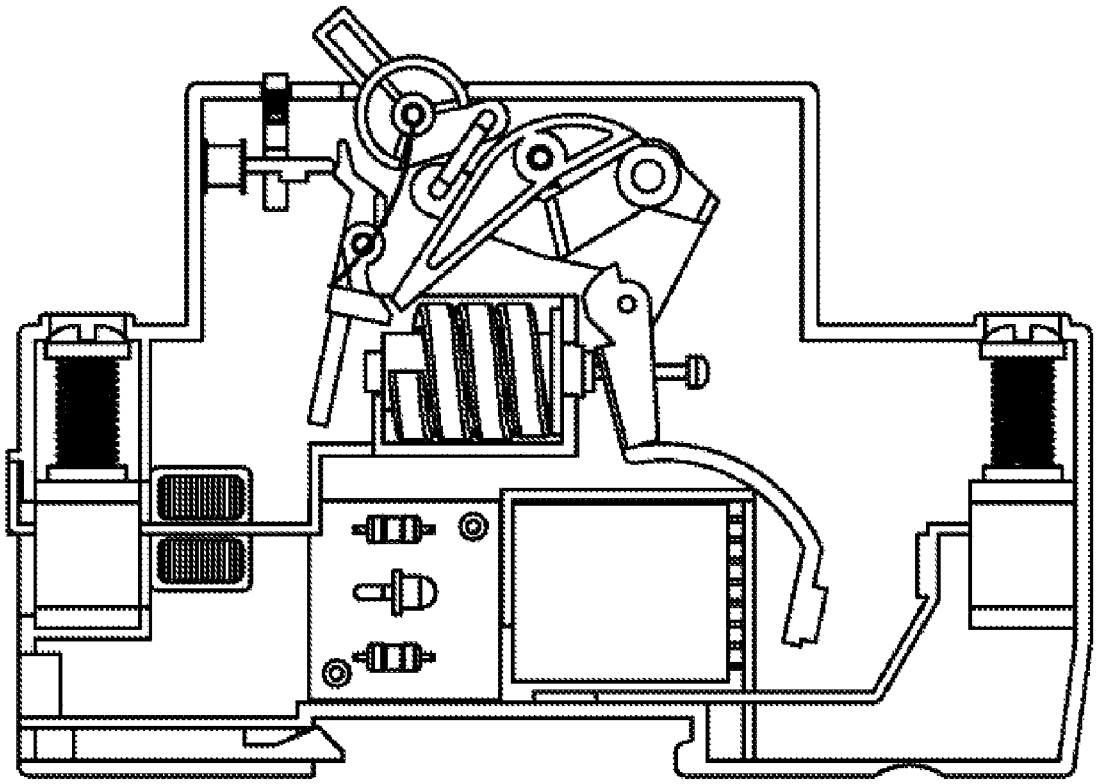
FIG. 14 is a schematic view of Embodiment 5 according to the present invention in a self-locking state.

Operation principle of this embodiment is the same as that of Embodiment 4 except that the electromagnet is controlled by the control circuit, see FIG. 14.

Embodiment 6

The self-locking mechanism of the present invention comprises an electromagnet, a reed pipe, and a self-locking control circuit electrically controlled by the reed pipe, see FIG.

Figure 15:
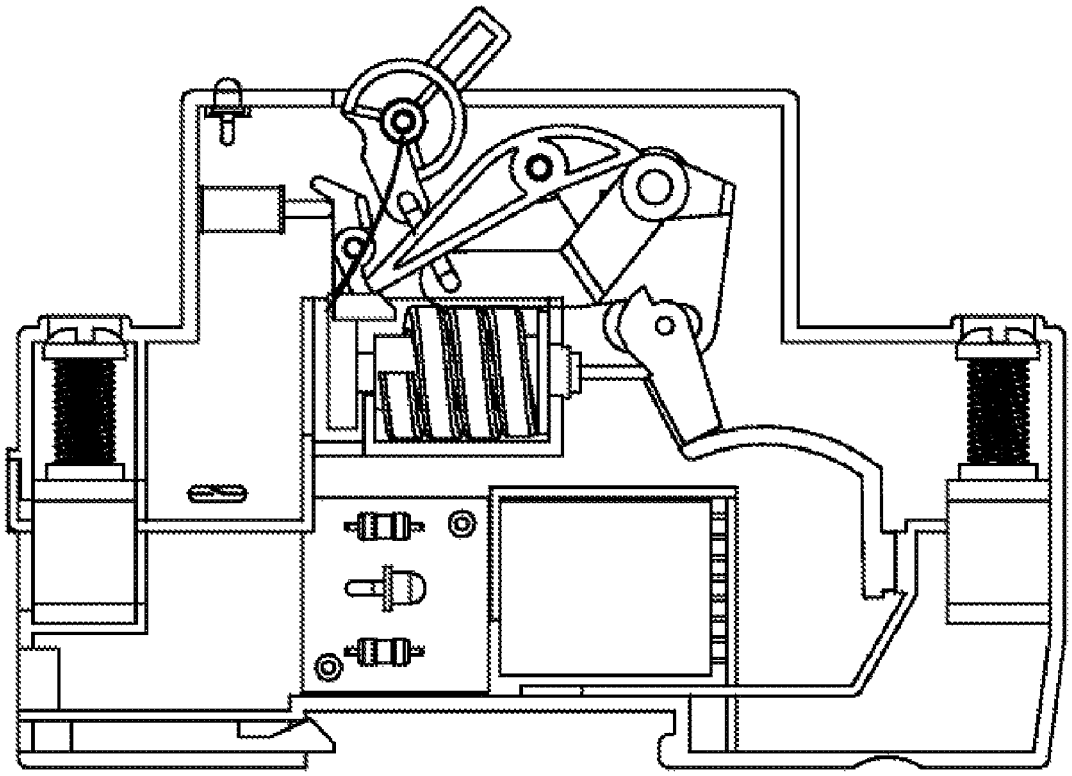
FIG. 15 is a schematic view of Embodiment 6 according to the present invention in a closed state.

41, all disposed in the housing of the circuit breaker. The electromagnet and the reed pipe are connected with the self-locking control circuit electrically controlled by the reed pipe. The reset mechanism is formed by a switch button. The reed pipe is disposed in the vicinity of the inner leads of the circuit breaker. The actuating arm is contacted with the upper portion of the tripping linkage of the circuit breaker, see FIG. 15.

Figure 16:
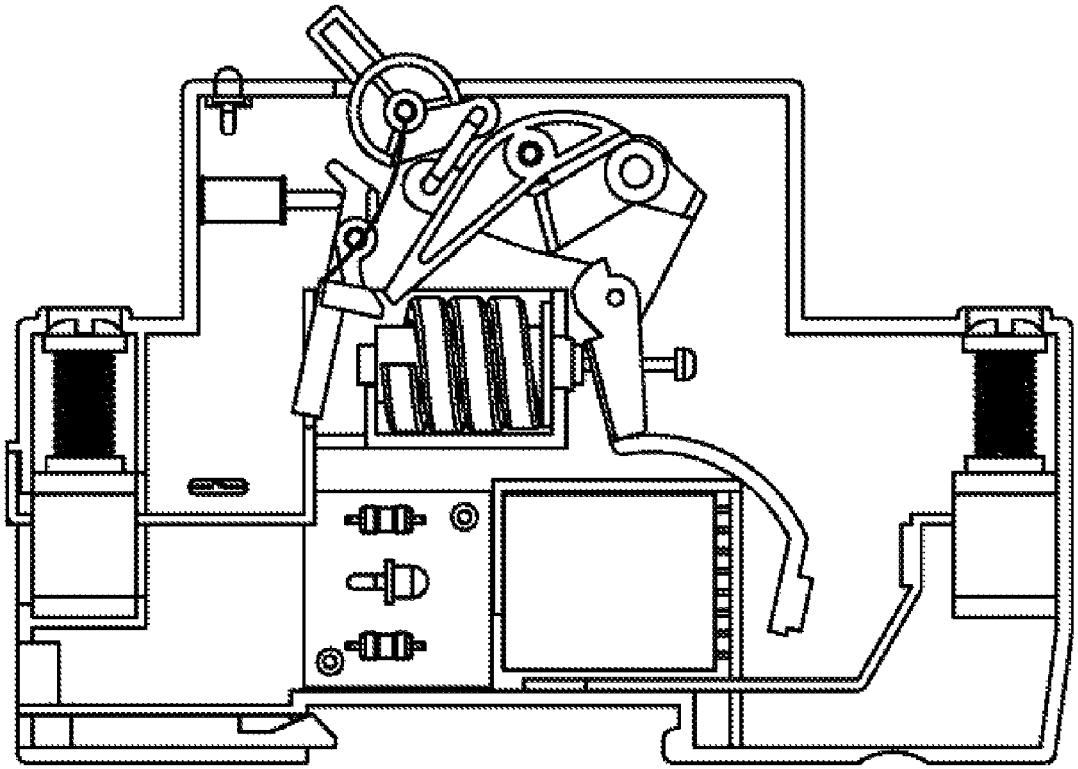
FIG. 16 is a schematic view of Embodiment 6 according to the present invention in a self-locking state.

Operation principle of this embodiment is as described below. When short circuit occurs, the current flowing in the inner leads of the circuit breaker is much higher than the rated current of the circuit breaker. A strong magnetic field is generated around the inner leads, which attracts the reed pipe. The self-locking control circuit electrically controlled by the reed pipe operates, and electricity is applied to the coil of the electromagnet. The actuating arm moves to cause the tripping linkage to rotate, which cooperates with the short circuit self-locking mechanism to open the circuit breaker. The tripping linkage is maintained in a tripped state and cannot restore such that the circuit breaker cannot be closed, even if the handle is closed, thereby achieving self-locking upon occurrence of a short circuit, as shown in FIG. 16. Resetting is accomplished by pressing the button to stop the self-locking control circuit electrically controlled by the reed pipe. The coil of the electromagnet is without electricity, and the actuating arm returns to its initial state. After the trip link is restored, the circuit breaker can be closed by closing the handle again.

Embodiment 7

Figure 17:
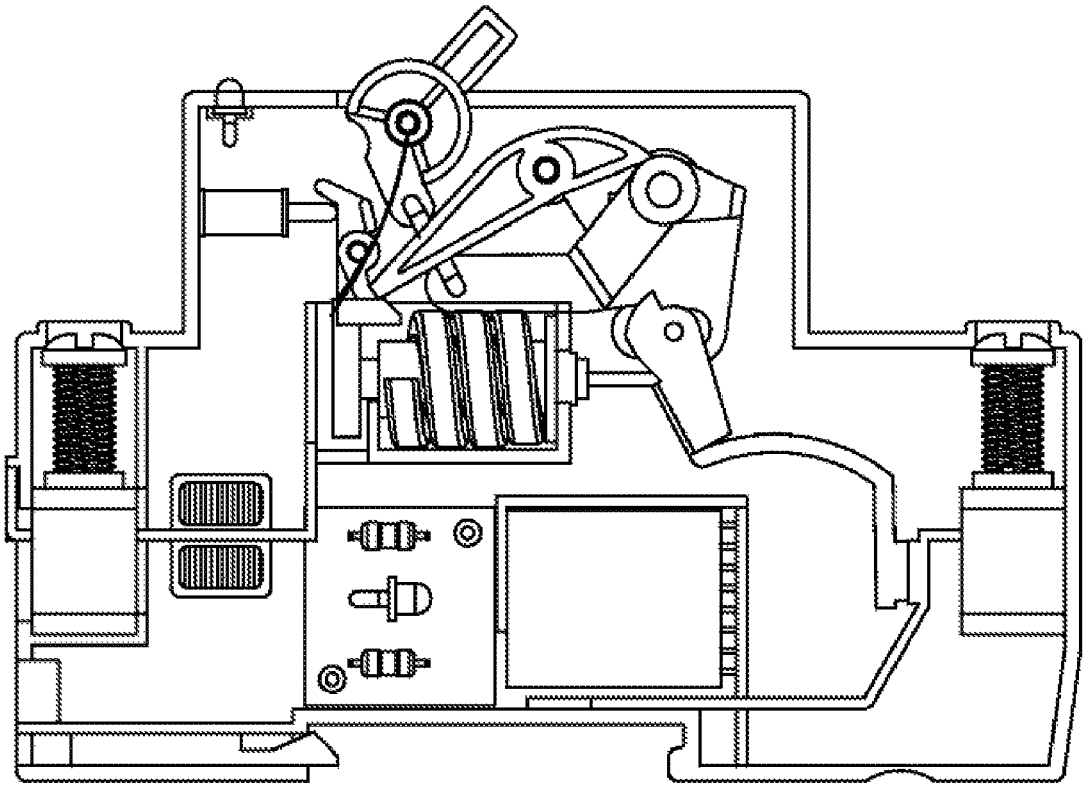
FIG. 17 is a schematic view of Embodiment 7 according to the present invention in a closed state.
Figure 18:
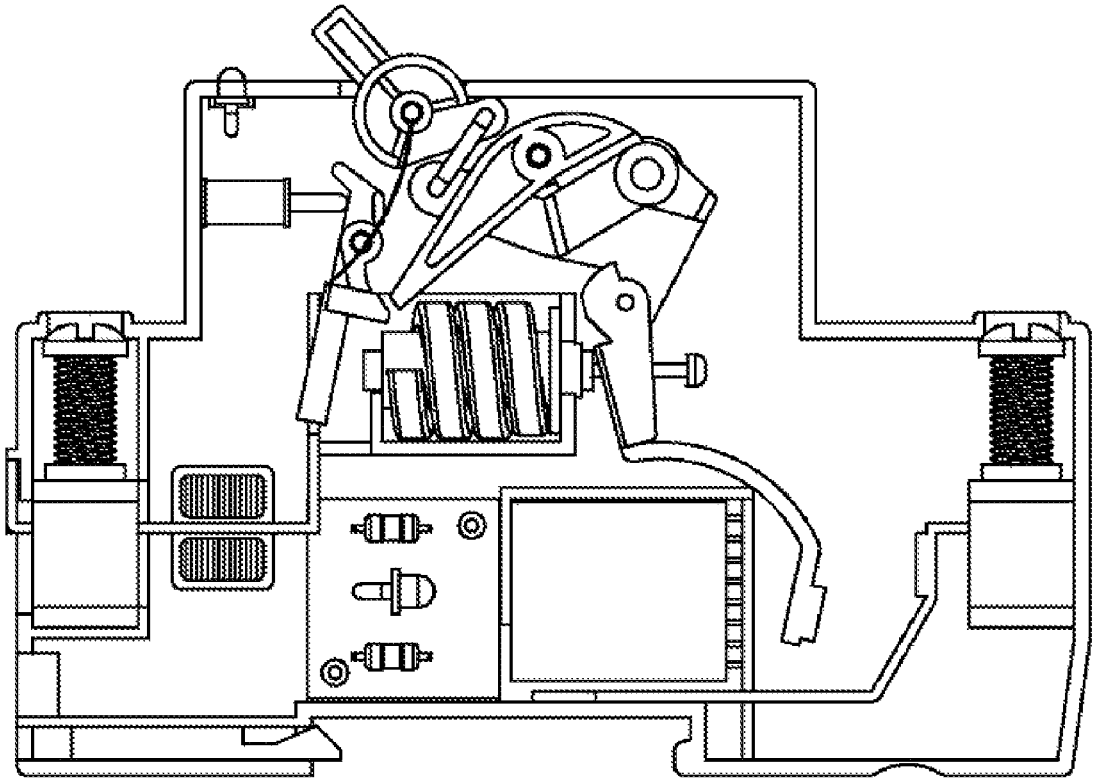
FIG. 18 is a schematic view of Embodiment 7 according to the present invention in a self-locking state.

The self-locking mechanism of the present invention comprises an electromagnet, a transformer, and a self-locking control circuit electrically controlled by the transformer (see FIG. 42) all disposed in the housing of the circuit breaker. The reset mechanism is formed by a switch button. The inner leads of the circuit breaker pass through the transformer, the output end of the transformer is connected with the self-locking control circuit electrically controlled by the transformer. The actuating arm is contacted with the upper portion of the tripping linkage of the circuit breaker, see FIG. 17.

Operation principle of this embodiment is almost the same as that of Embodiment 6, except that the circuit diagram of the self-locking control circuit is different, see FIG. 14.

Embodiment 8

Figure 19:
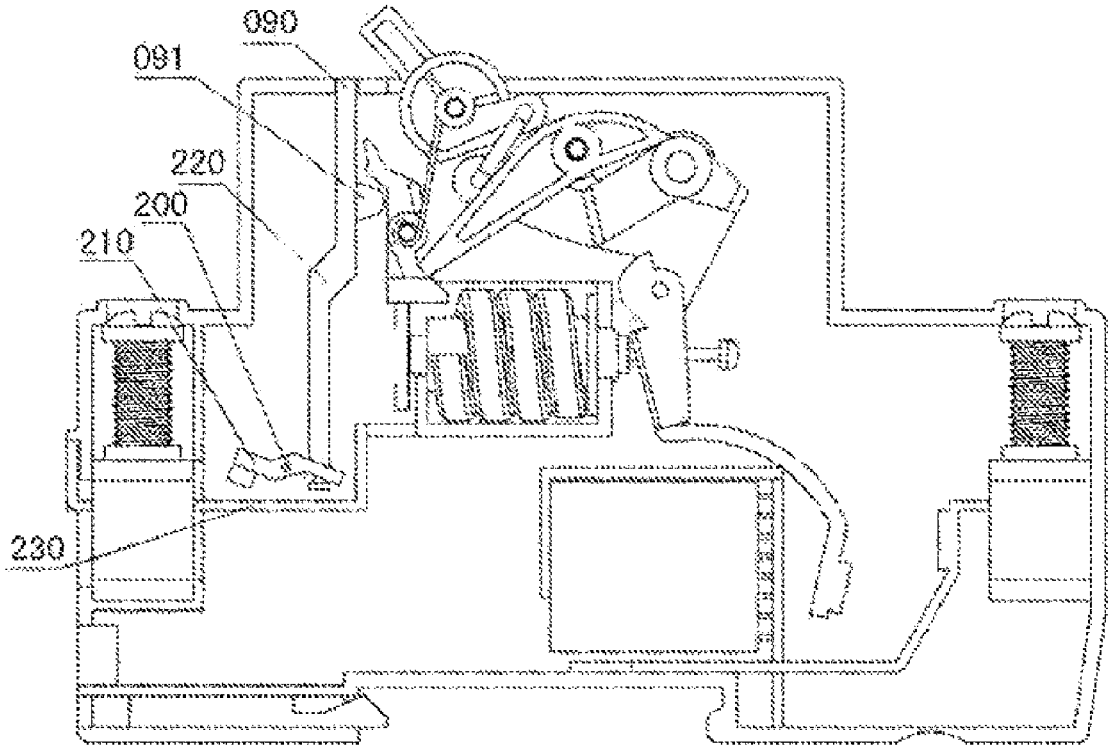
FIG. 19 is a schematic view of Embodiment 8 according to the present invention in an open state.

The self-locking mechanism comprises a magnetic actuating element being a rotating plate, a middle portion of the rotating plate is connected with a pivoting shaft disposed on an inner wall of the housing, the rotating plate is rotatable with respect to the pivoting shaft, a magnetic block is disposed at a first end of the rotating plate, and is a magnet or an iron sheet, or contains a magnetic media that can be attracted by a magnetic field, the reset mechanism comprises a rod-shaped trigger arm with a first end being a trigger end and connected with a second end of the rotating plate, the second end of the trigger arm is a reset button protruding from the housing such that the trigger arm moves along a specific direction in operation, the trigger arm further comprises a convex block abutting against the tripping linkage, see FIG. 19.

Figure 20:
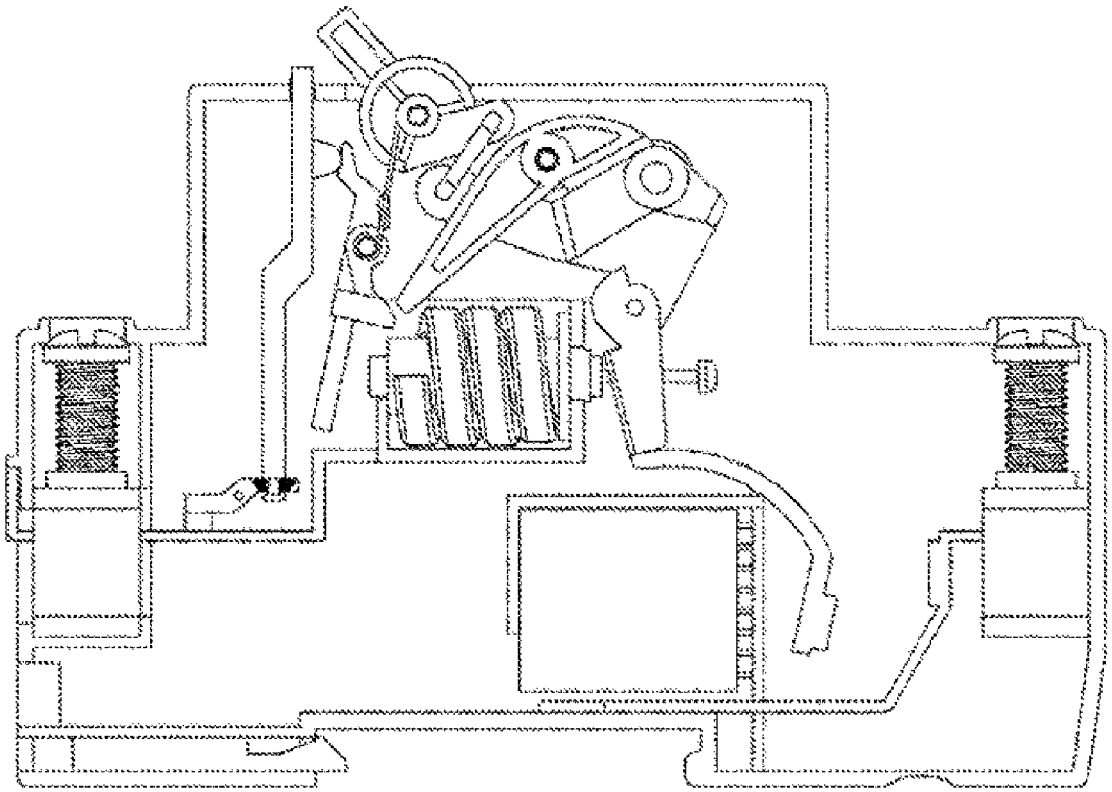
FIG. 20 is a schematic view of Embodiment 8 according to the present invention in a self-locking state.

FIG. 20 shows an inner structure of this embodiment upon occurrence of short circuit. For the structure of the present invention, upon occurrence of a short circuit, the circuit leads generate a strong magnetic field and the rotating plate pivots on the pivoting shaft until the first end with the magnetic block disposed thereon abuts against the circuit leads, which triggers the trigger arm to move upward. The reset button protrudes from the housing to indicate that the circuit is open as a result of short circuit. The convex block pushes the abutting portion to force the tripping linkage to move. Even if the strong magnetic field disappears after the circuit is opened, the trigger arm cannot restore due to the force generated by the spring in the reset button and the convex block. Thus, the present invention not only achieves short circuit protection, but also achieves self-locking upon occurrence of a short circuit due to the designed structure. The handle cannot be moved to close the circuit breaker until a user presses down the reset button, which improves the safety of the circuit breaker.

Embodiment 9

Figure 21:
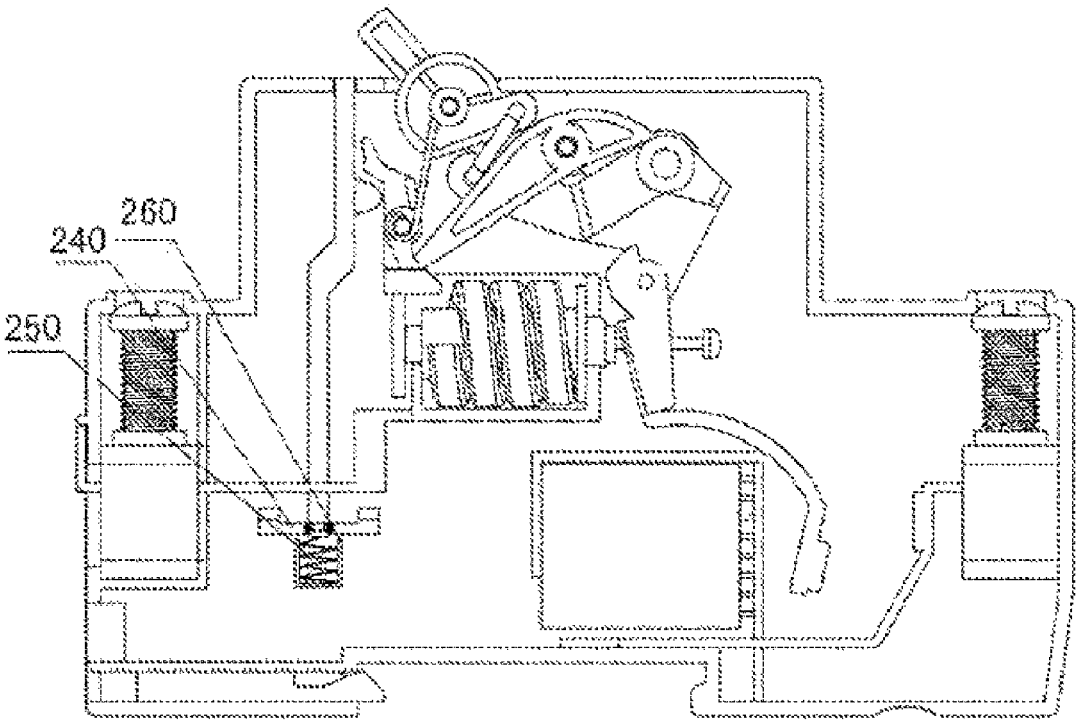
FIG. 21 is a schematic view of Embodiment 9 according to the present invention in an open state.

The characteristic of this embodiment, compared with Embodiment 8, is that the magnetic actuating element is a magnetic shelf with a pair of magnetic media blocks being disposed on both ends thereof, the magnetic media block is a magnet or an iron sheet, or contains a magnetic media that can be attracted by a magnetic field, the reset mechanism comprises a rod-shaped trigger arm, a first end thereof is a trigger end connected with a middle portion of the magnetic shelf, a second end of the trigger arm is a reset button extending to the top of the housing such that the trigger arm moves along a specific direction in operation, the trigger arm further comprises a convex block abutting against the tripping linkage, see FIG. 21.

Figure 22:
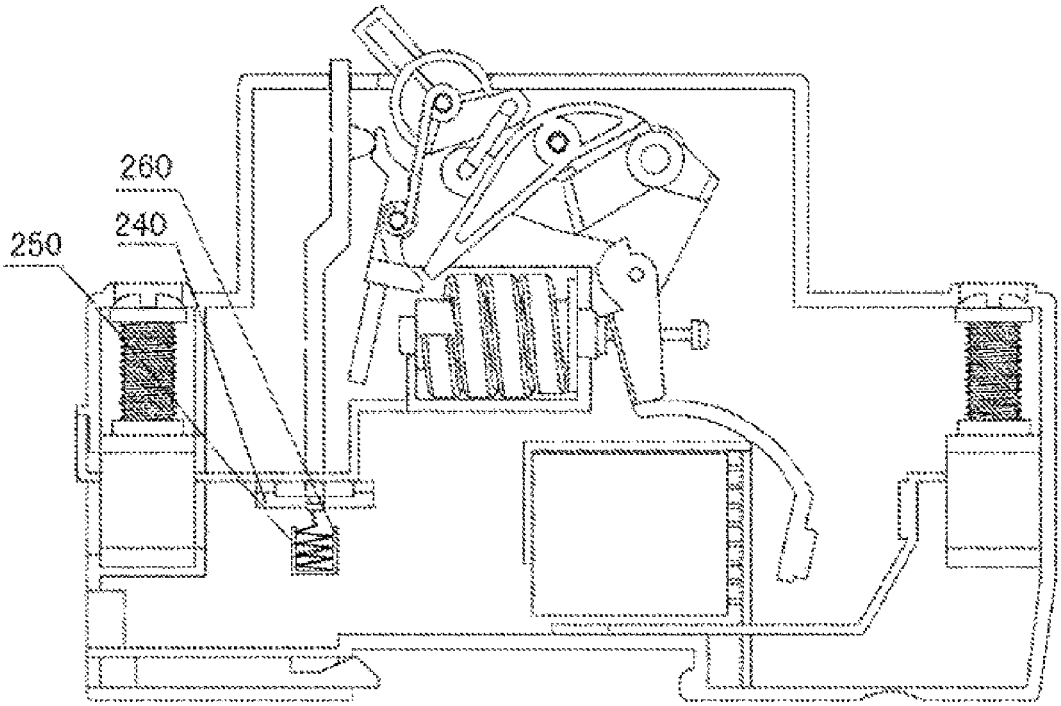
FIG. 22 is a schematic view of Embodiment 9 according to the present invention in a self-locking state.

FIG. 22 shows an inner structure of this embodiment upon occurrence of short circuit. For the structure of the present invention, upon occurrence of a short circuit, the circuit leads generate a strong magnetic field, and the magnetic shelf moves upward immediately until the magnetic media block disposed thereon abuts against the circuit leads, which triggers the trigger arm to move upward. The reset button protrudes from the housing to indicate that the circuit is open due to short circuit. The convex block pushes the abutting portion to force the tripping linkage to move. Even if the strong magnetic field disappears after the circuit has opened, the trigger arm cannot restore due to the force generated by the spring in the reset button and the convex block. Thus, the present invention not only achieves short circuit protection, but also achieves self-locking upon occurrence of a short circuit due to the designed structure. The handle cannot be moved to close the circuit breaker until a user presses down the reset button, which improves the safety of the circuit breaker.

The magnetic shelf and the short circuit actuating mechanism do not act at the same time upon occurrence of an overcurrent because a supporting frame is provided under the magnetic shelf. The supporting frame is disposed in the housing and is connected with a lower portion of the magnetic shelf through a spring. The circuit generates a suction force on the magnetic shelf due to the magnetic field generated when an overcurrent occurs. Due to the force generated by the spring, the magnetic shelf will not abut the circuit.

Embodiment 10

Figure 23:
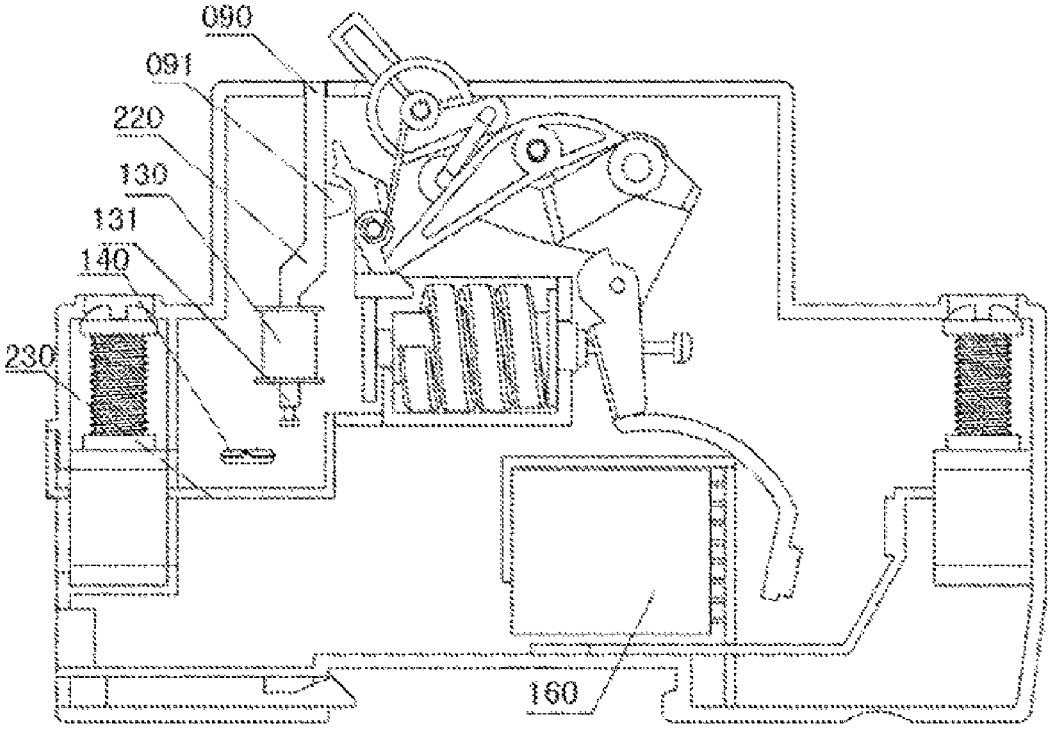
FIG. 23 is a schematic view of Embodiment 10 according to the present invention in an open state.

The self-locking mechanism comprises a short circuit detecting circuit and an electromagnetic actuating mechanism, the short circuit detecting circuit operates to detect a short circuit fault, and comprises a reed pipe disposed in the vicinity of an inner lead of the circuit breaker, and operating to generate a strong magnetic field whereby forcing separated contacts in the reed pipe to attract each other as a short circuit fault occurs, the reset mechanism comprises an electromagnet with a trigger arm being disposed on an armature end of the electromagnet, a lower end of the trigger arm is connected with the armature end of the electromagnet, a reset button is disposed on an upper portion of the trigger arm such that as the electromagnet is triggered, the armature moves upward and drives the trigger arm to move, the trigger arm further comprises a convex block abutting against the tripping linkage, see FIG. 23.

Figure 24:
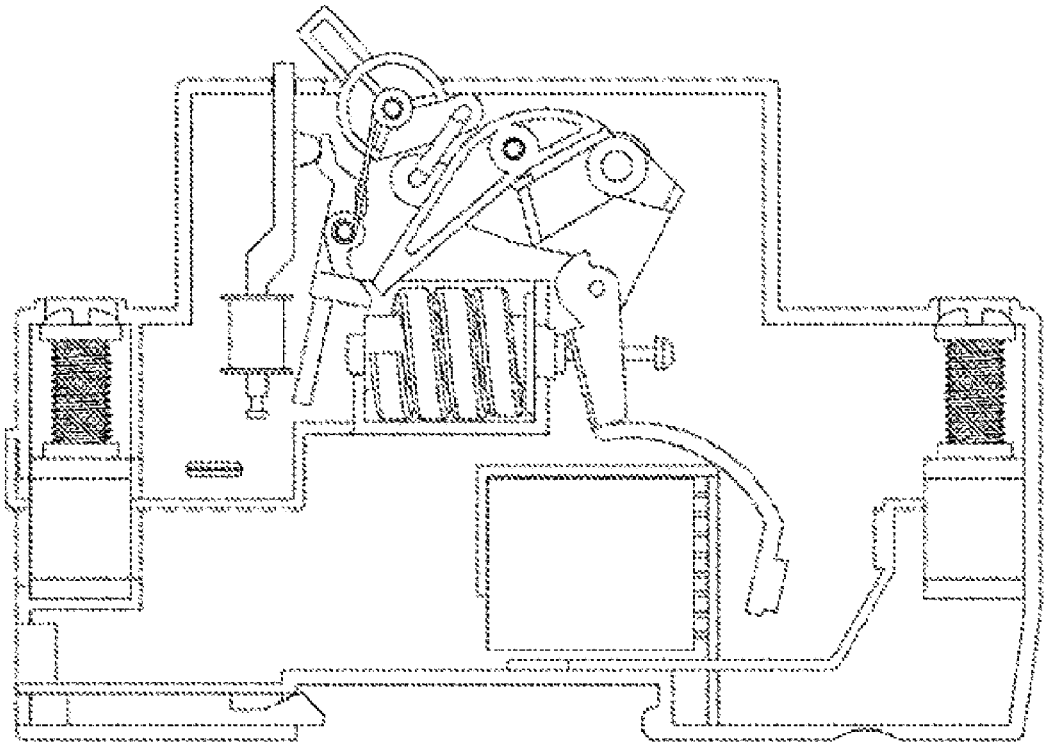
FIG. 24 is a schematic view of Embodiment 10 according to the present invention in a self-locking state.

FIG. 24 shows an inner structure of this embodiment upon occurrence of short circuit. Upon occurrence of a short circuit, the circuit leads generate a strong magnetic field and the contact sheets in the reed pipe attract each other to generate a trigger signal (the principle of generating the signal is described below). The electromagnet of the electromagnetic activating mechanism acts after receiving the trigger signal. The magnet moves upward and in turn forces the trigger arm to move upward. The reset button protrudes from the housing to indicate that the circuit is open due to occurrence of short circuit. The convex block pushes the abutting portion to force the tripping linkage to move. Even if the strong magnetic field disappears after the circuit has opened, the trigger arm cannot restore due to the force generated by the spring in the reset button and the convex block. Thus, the present invention not only achieves a short circuit protection, but also achieves self-locking upon occurrence of a short circuit due to its artful structure. The handle cannot be moved to close the circuit breaker until a user presses down the reset button, which improves the safety of the circuit breaker.

Embodiment 11

Figure 25:
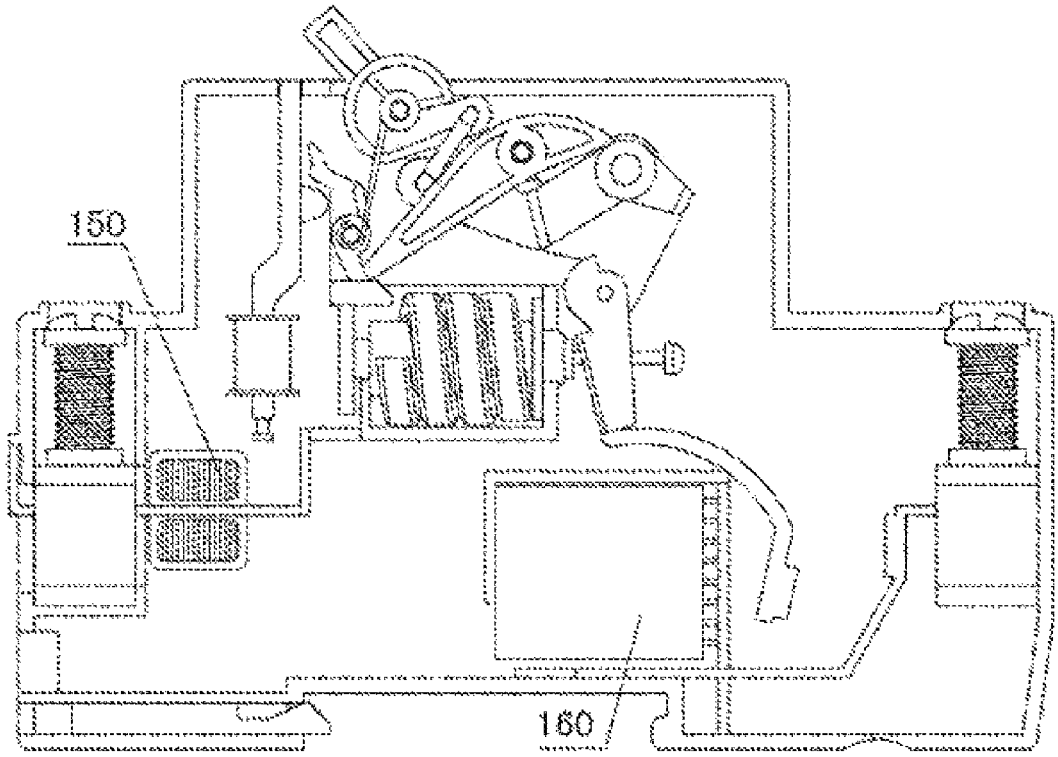
FIG. 25 is a schematic view of Embodiment 11 according to the present invention in an open state.

The self-locking mechanism comprises a short circuit detecting circuit and an electromagnetic actuating mechanism, the short circuit detecting circuit operates to detect a short circuit fault, and comprises a transformer disposed on an inner lead of the circuit breaker, and operating to induce a voltage signal as a short circuit fault occurs and current instantly increases, the electromagnetic actuating mechanism comprises an electromagnet with a trigger arm being disposed at an armature end of the electromagnet, a lower end of the trigger arm is connected with the armature of the electromagnet, a reset button is disposed on an upper end of the trigger arm and extends to the outside of the housing, so that after the electromagnet is triggered, the armature moves upward and forces the trigger arm to move, the trigger arm further comprises a convex block abutting against the tripping linkage, see FIG. 25.

Figure 26:
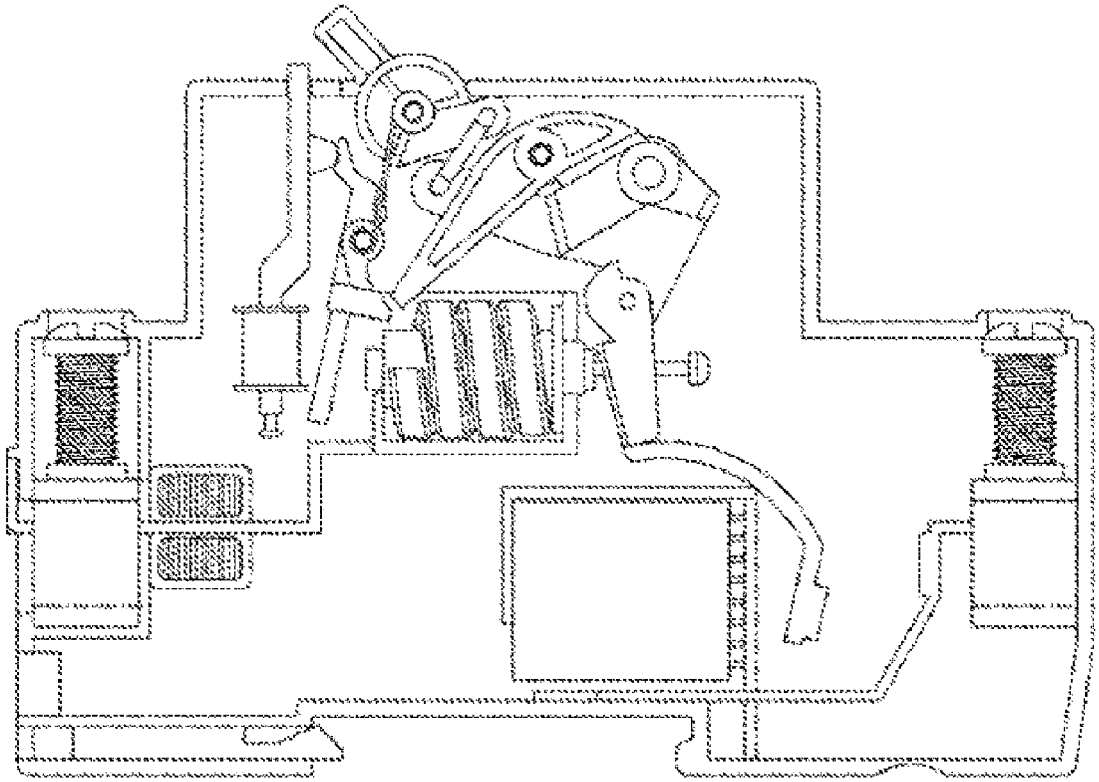
FIG. 26 is a schematic view of Embodiment 11 according to the present invention in a self-locking state.
Figure 27:
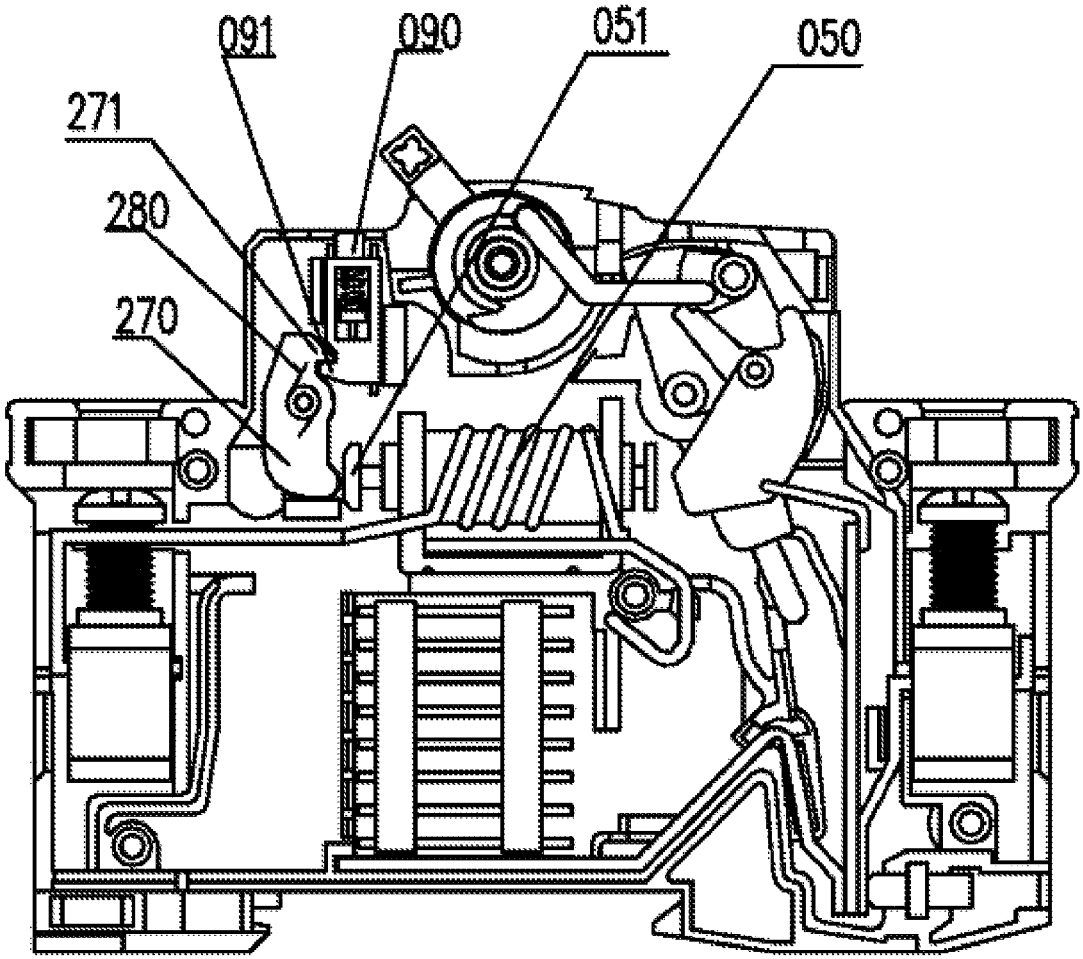
FIG. 27 is a schematic view of Embodiment 12 according to the present invention in an open state.

FIG. 26 shows an inner structure of this embodiment upon occurrence of short circuit. Upon occurrence of a short circuit, an induced voltage is generated in the coil of the transformer and a trigger signal is generated. The electromagnet of the electromagnetic activating mechanism acts after receiving the trigger signal. The magnet moves upward and in turn forces the trigger arm to move upward. The reset button protrudes from the housing to indicate that the circuit is open due to short circuit. The convex block pushes the abutting portion to force the tripping linkage to move. Even if the strong magnetic field disappears after the circuit has opened, the trigger arm cannot restore due to the force generated by the spring in the reset button and the convex block. Thus, the present invention not only achieves short circuit protection, but also achieves self-locking upon occurrence of a short circuit due to the designed structure. The handle cannot be moved to close the circuit breaker until a user presses down the reset button, which improves the safety of the circuit breaker.

Embodiment 12

The self-locking mechanism comprises a rotating arm, a middle portion of the rotating arm is hinged on the housing of the circuit breaker, a torsion spring is disposed on the rotating arm, a lower end of the rotating arm is contacted with a actuating arm of the short circuit actuating mechanism, a convex edge is disposed on an upper portion of the rotating arm, the reset mechanism is formed by a button having a compression spring being disposed therein and engaged with the rotating arm, a convex block is disposed at the lower portion of the button, as the compression spring in the button is compressed, the convex block at the lower portion of the button is disposed below the convex edge on the upper portion of the rotating arm.

Figure 28:
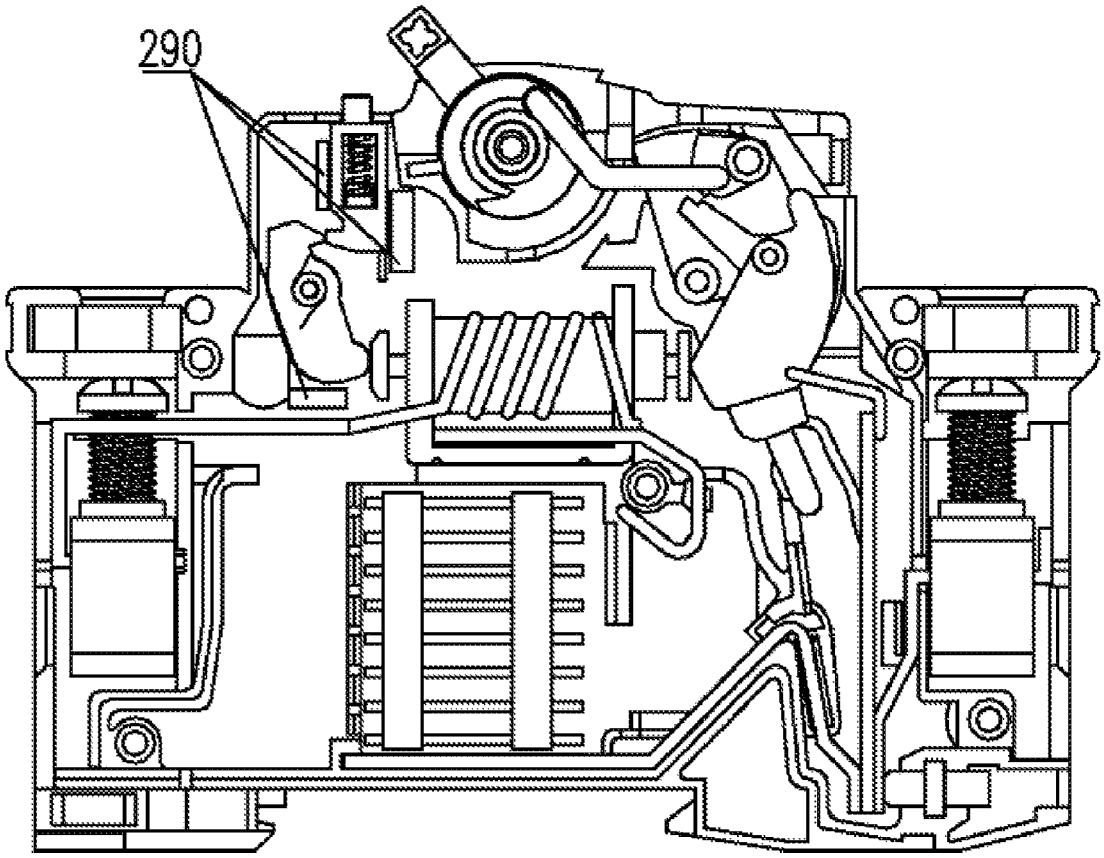
FIG. 28 is a schematic view of Embodiment 12 according to the present invention in a self-locking state.

Operation principle of this embodiment is as described below. When short circuit occurs, the current flowing in the short circuit actuating mechanism is much higher than the rated current of the circuit breaker, which causes the actuating arm of the short circuit actuating mechanism to push the lower end of the tripping linkage so as to make the tripping linkage rotate, thereby opening the circuit breaker. In parallel, the rotating arm rotates under the force of the torsion spring. The lower end of the rotating arm remains in contact with the actuating arm of the short circuit actuating mechanism, and the protruding edge at the upper portion of the rotating arm disengages from the convex block at the lower end of the button due to the rotation of the rotating arm such that the compression spring in the button is restored and the convex block at the lower end of the button moves upward along with the button until it abuts a side of the protruding edge at the upper portion of the rotating arm, as shown in FIG. 28. The actuating arm of the short circuit actuating mechanism is restrained by the lower end of the rotating arm and cannot return. That is to say, the actuating arm of the short circuit actuating mechanism maintains the tripping linkage in a tripped state such that the circuit breaker cannot be closed, even if the handle is closed, which achieves self-locking upon occurrence of short circuit. Resetting is accomplished by pressing the button to position the convex block at the lower end of the button under the protruding edge at the upper portion of the rotating arm so as to restore the actuating arm of the short circuit actuating mechanism. After the trip link is restored, the circuit breaker can be closed by closing the handle again.

Embodiment 13

Figure 29:
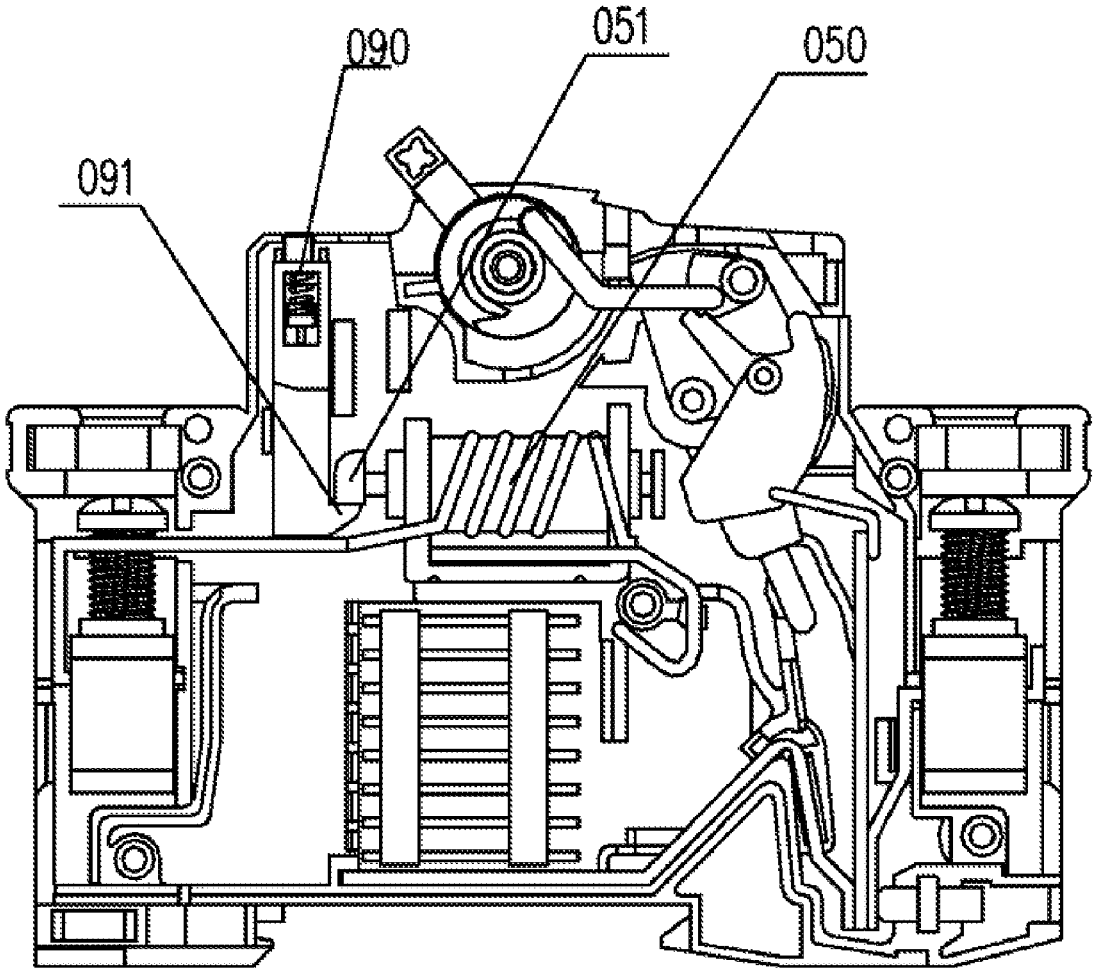
FIG. 29 is a schematic view of Embodiment 13 according to the present invention in an open state.

The self-locking mechanism and the reset mechanism comprise a button with a compression spring being disposed therein, a convex block is disposed at the lower portion of the button, as the compression spring is compressed, the convex block at the lower portion of the button is disposed below the actuating arm of the short circuit actuating mechanism, see FIG. 29.

Figure 30:
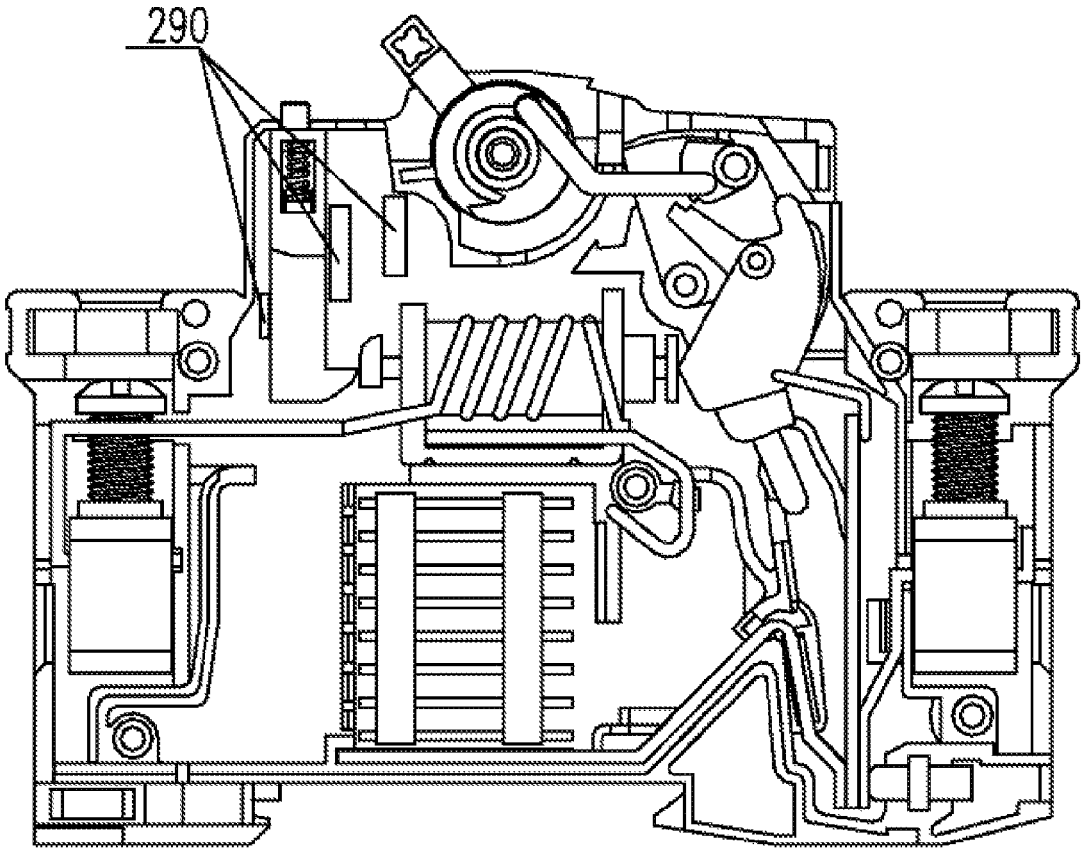
FIG. 30 is a schematic view of Embodiment 13 according to the present invention in a self-locking state.

Operation principle of this embodiment is as described below. When short circuit occurs, the current flowing in the short circuit actuating mechanism is much higher than the rated current of the circuit breaker, which causes the actuating arm of the short circuit actuating mechanism to push the lower end of the tripping linkage so as to make the short circuit actuating mechanism rotate, thereby opening the circuit breaker. At the same time, the movement of the actuating arm of the short circuit actuating mechanism causes the convex block at the lower end of the button to disengage from the actuating arm, and the convex block at the lower end of the button moves upward under the restoring force of the compression spring in the button such that the convex block at the lower end of the button is contacted with one end of the actuating arm of the short circuit actuating mechanism, see FIG. 30. The actuating arm of the short circuit actuating mechanism is restrained by the convex block at the lower end of the button and cannot return. That is, the actuating arm of the short circuit actuating mechanism maintains the tripping linkage in a tripped state such that the circuit breaker cannot be closed, even if the handle is closed, which achieves self-locking upon occurrence of short circuit. Resetting is accomplished by pressing the button to position the convex block at the lower end of the button under the actuating arm of the short circuit actuating mechanism so as to restore the actuating arm of the short circuit actuating mechanism. After the trip link is restored, the circuit breaker can be closed by closing the handle again.

The self-locking mechanism and the reset mechanism comprise limit blocks mounted on the housing of the circuit breaker to securely fix the self-locking mechanism and the reset mechanism in the circuit breaker.

The present invention may be applied in a three-phase moulded case circuit breaker (air switch).

Embodiment 14

Figure 31:
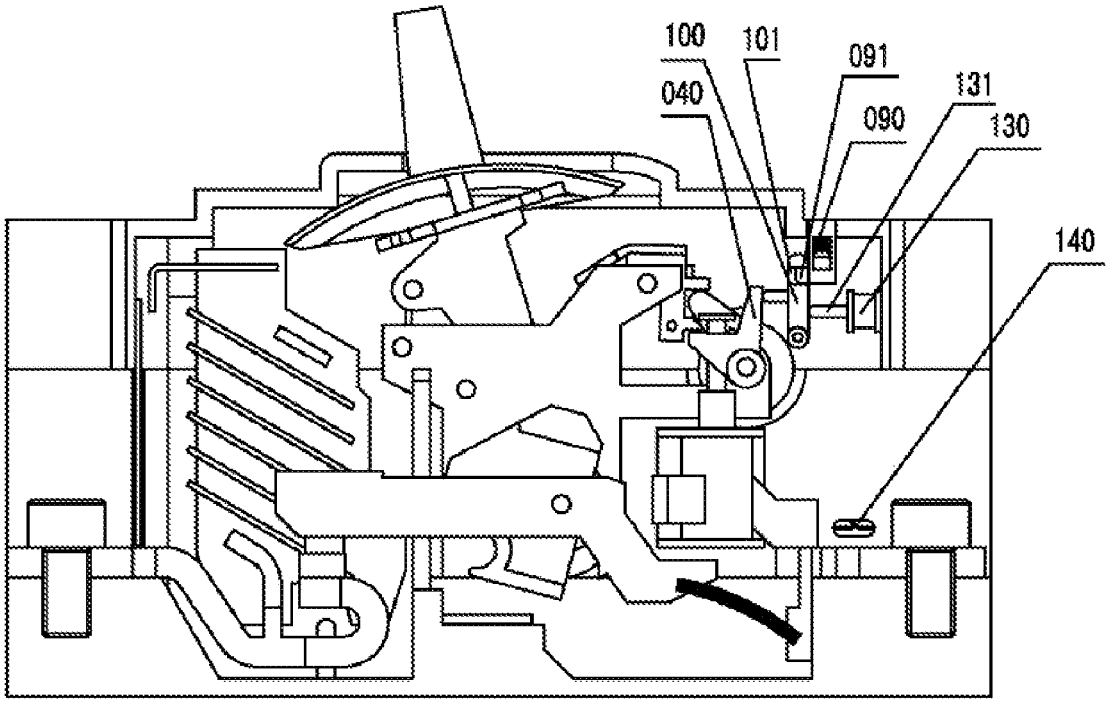
FIG. 31 is a schematic view of Embodiment 14 according to the present invention in an open state.

The self-locking mechanism comprises an electromagnet and a reed pipe disposed in the housing of the circuit breaker, and a rotating rod with a lower end being hinged in the housing of the circuit breaker, an upper end of the rotating rod is contacted with an upper portion of a tripping linkage, an extension rod with a groove is disposed at an upper portion of the tripping linkage, the reset mechanism is formed by a button having a compression spring being disposed therein and engaged with the extension rod with the groove, a convex block is disposed at the lower portion of the button, as the compression spring in the button is compressed, the convex block at the lower portion of the button is disposed in the groove of the extension rod, the reed pipe is disposed in the vicinity of an inner lead of the circuit breaker, the electromagnet is located in the vicinity of the rotating rod, a coil of the electromagnet is serially connected with the reed pipe and then with an power supply input to the circuit breaker, and a actuating arm of the electromagnet is contacted with an upper portion of a hinged point of the rotating rod, see FIG. 31.

Figure 32:
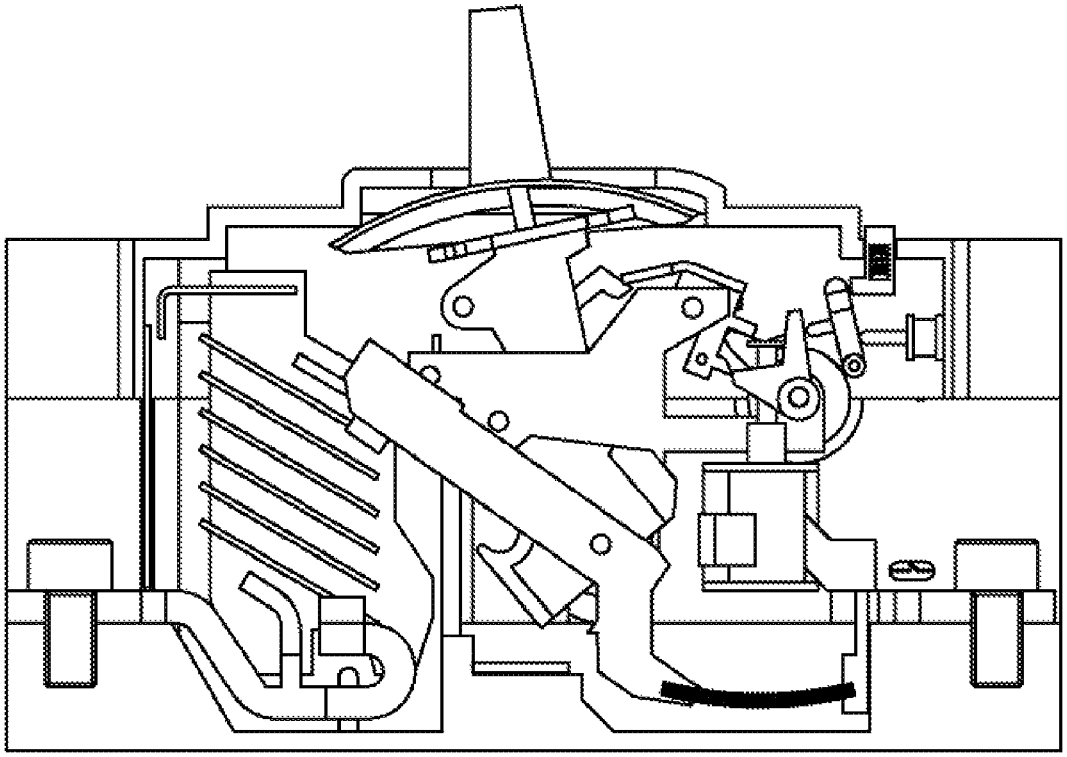
FIG. 32 is a schematic view of Embodiment 14 according to the present invention in a self-locking state.

Operation principle of this embodiment is as described below. When short circuit occurs, the current flowing in the inner leads of the circuit breaker is much higher than the rated current of the circuit breaker. A strong magnetic field is generated around the inner leads, which attracts the reed pipe. The electricity is applied to the coil of the electromagnet, and the actuating arm moves to push the rotating rod, causing it to rotate, thereby pushing the tripping linkage to rotate, which cooperates with the short circuit self-locking mechanism to open the circuit breaker. At the same time, the rotation of the tripping linkage forces the convex block at the lower portion of the button to disengage from the groove in the upper portion of the rotating rod, which causes restoration of the compression spring. The convex block at the lower portion of the button moves upward along with the button and abuts one side of the rotating rod, as shown in FIG. 32. Even if the rotating rod returns to its original position after the circuit breaker trips, the tripping linkage remains in a tripped state and cannot return, such that the circuit breaker cannot be closed, even if the handle is closed, which achieves self-locking upon occurrence of short circuit. Resetting is accomplished by pressing the button to cause the convex block at the lower end of the button to be positioned in the groove in the upper portion of the rotating rod, which restores the trip link such that the circuit breaker can be closed again by closing the handle again.

Embodiment 15

Figure 33:
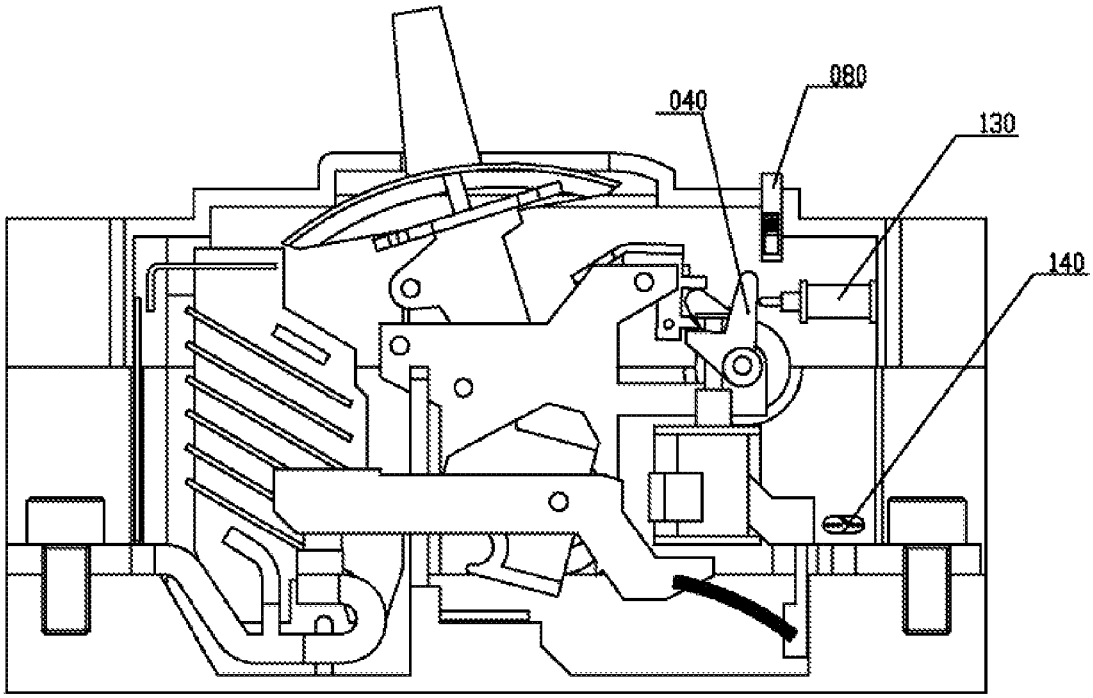
FIG. 33 is a schematic view of Embodiment 15 according to the present invention in an open state.
Figure 34:
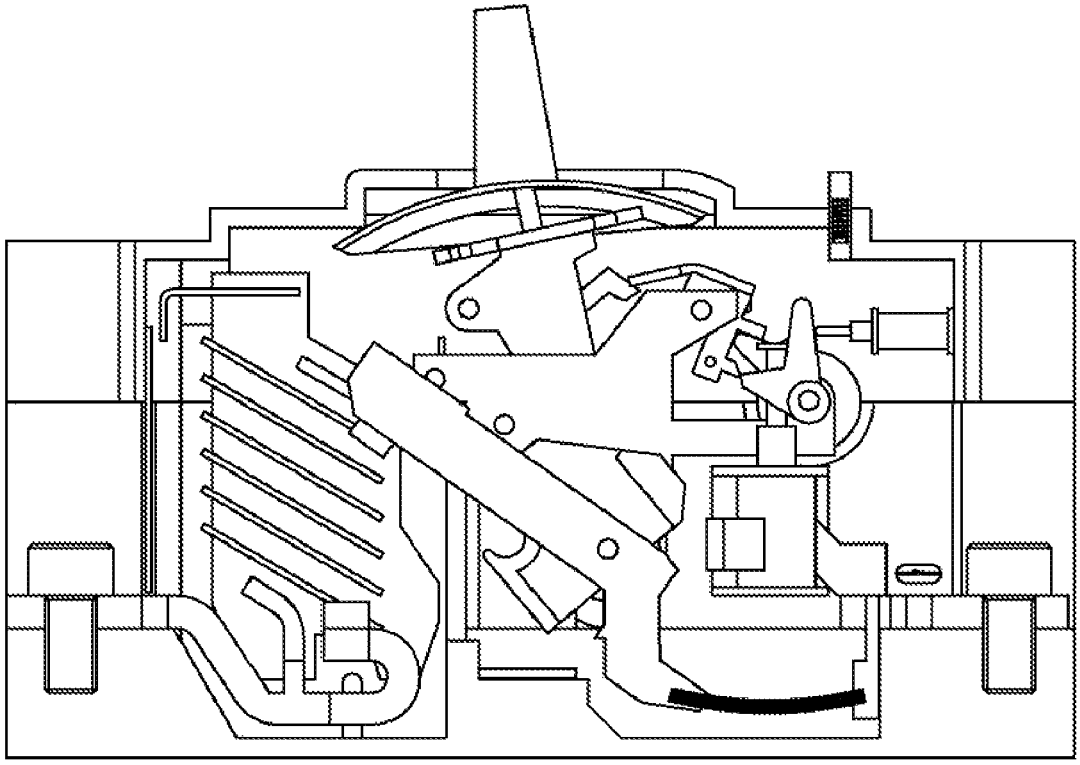
FIG. 34 is a schematic view of Embodiment 15 according to the present invention in a self-locking state.
Figure 45:
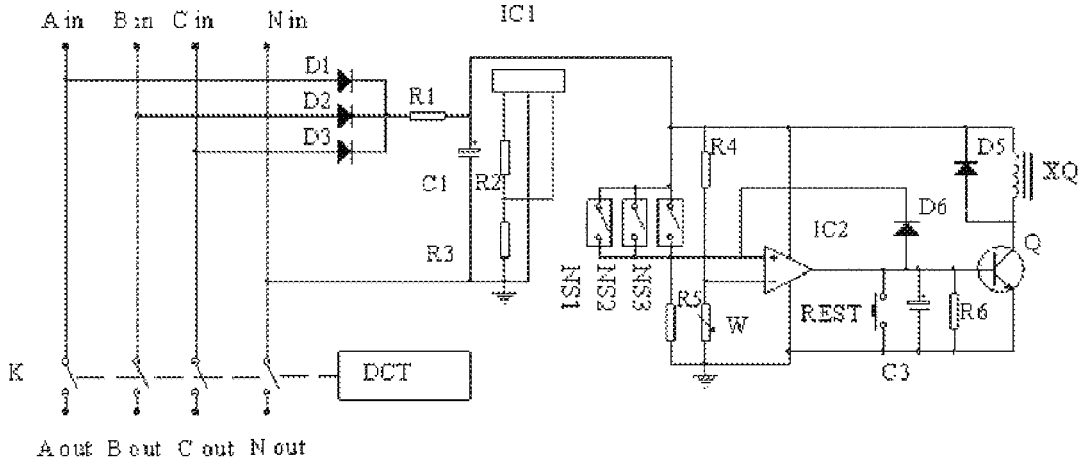
FIG. 45 is a circuit diagram illustrating a self-locking control circuit electrically controlled by three-phase reed pipes according to the present invention.

The self-locking control circuit electrically controlled by a reed pipe in Embodiment 6 of the present invention can be applied to a three-phase moulded case circuit breaker, as shown in FIG. 33. The structure is the same, except that the shape of the tripping linkage is different, and the control circuit must be modified to form a three-phase control circuit, as shown in FIG. 45. The operation principle of this embodiment is the same as that described in Embodiment 6 of the present invention.

Similarly, the self-locking control circuit electrically controlled by a transformer in Embodiment 7 of the present invention, may be applied to a three-phase moulded case circuit breaker, and the control circuit must be modified to form a three-phase control circuit.

Embodiment 16

Figure 35:
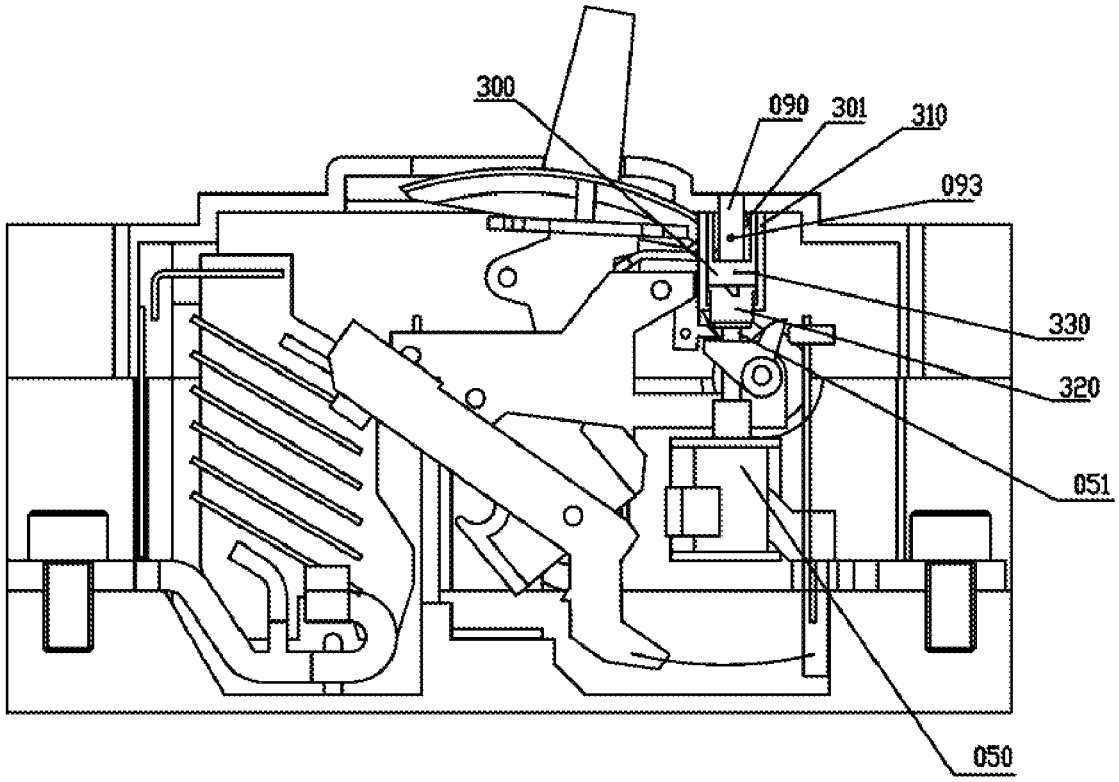
FIG. 35 is a schematic view of Embodiment 16 according to the present invention in an open state.

The self-locking mechanism and the reset mechanism comprise an outer sleeve, a reset button, a rotating sleeve and a movable block, the outer sleeve is fixed on a housing of a three-phase moulded case circuit breaker, a protruding portion is formed at the lower portion of the outer sleeve; the rotating sleeve and the movable block are disposed in the outer sleeve, a transverse extension spring is disposed between the outer sleeve and the rotating sleeve, the outer sleeve extends from a lower portion of the movable block and is contacted with the actuating arm of the short circuit actuating mechanism of the three-phase moulded case circuit breaker, a groove is disposed at an upper portion of the movable block, and outer convex edges are formed at both sides of the upper portion, the outer convex edges are disposed on the protruding portion of the outer sleeve; the rotating sleeve is disposed above the movable block, a compression spring is disposed between the rotating sleeve and the movable block, another protruding portion fit with the groove on the upper portion of the movable block is disposed on a lower portion of the rotating sleeve, the upper portion of the rotating sleeve is contacted with the housing of the three-phase moulded case circuit breaker, a spiral groove is disposed in the rotating sleeve; the reset button is disposed in the rotating sleeve, and has a bolt received in the spiral groove of the rotating sleeve, see FIG. 35.

Figure 36:
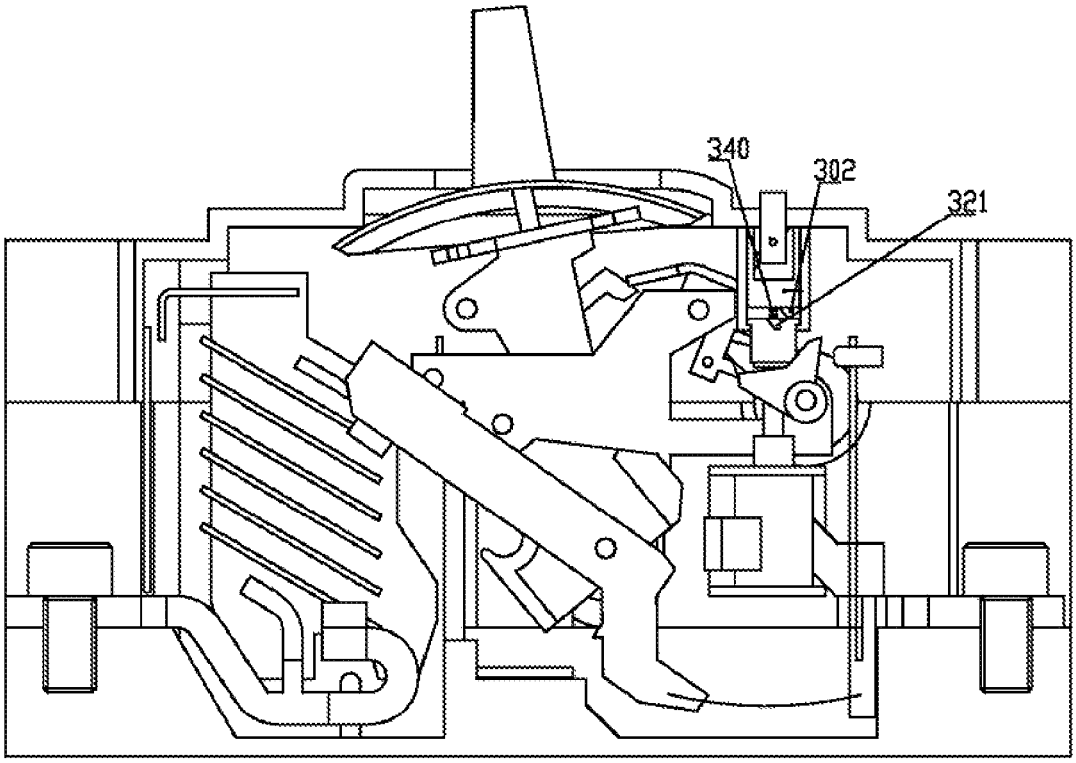
FIG. 36 is a schematic view of Embodiment 16 according to the present invention in a self-locking state.
Figure 37:
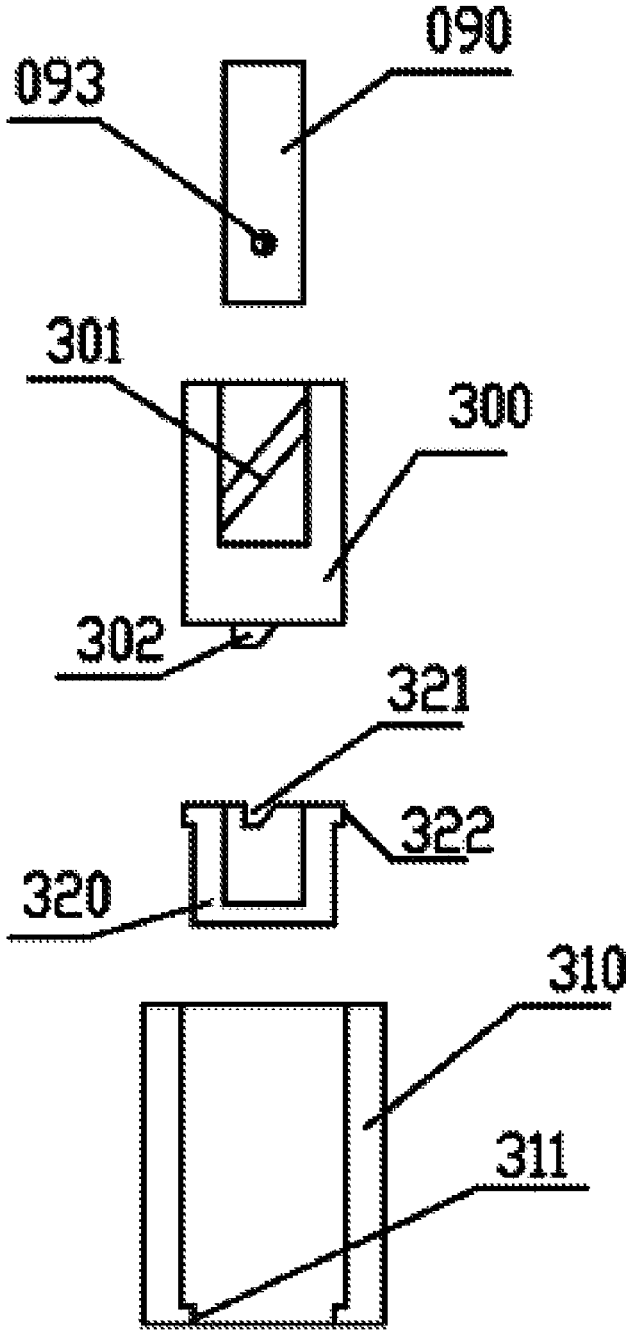
FIG. 37 is a schematic view of a self-locking mechanism upon tripping of the circuit breaker of Embodiment 16 according to the present invention.
Figure 38:
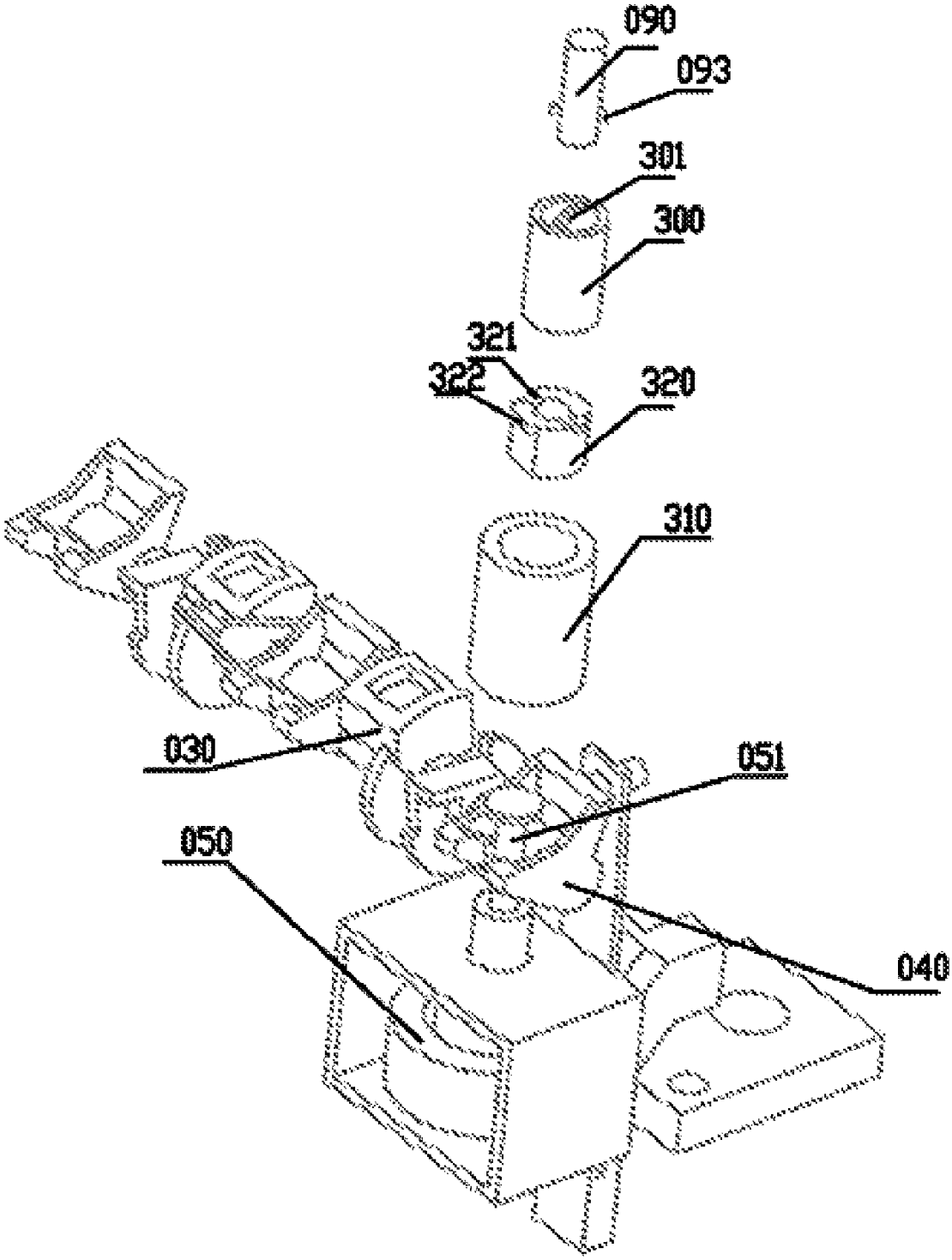
FIG. 38 is an axonometric drawing of a short circuit self-locking mechanism of Embodiment 16 according to the present invention.

Operation principle of this embodiment is as described below. When the three-phase moulded case circuit breaker works normally, the actuating arm of the short circuit actuating mechanism is restrained by the lower portion of the movable block and the force of the actuating arm is much larger than the force of the compression spring between the rotating sleeve and the movable block. Therefore, as short circuit fault occurs, the protruding portion of the rotating sleeve is inserted into the groove at the upper portion of the movable block. When short circuit occurs, the coil of the short circuit actuating mechanism drives the actuating arm of the short circuit actuating mechanism to push the lower end of the tripping linkage, which causes the tripping linkage to rotate, thereby opening the circuit breaker. At the same time, the actuating arm disengages from the lower portion of the movable block, and the movable block moves downward under the force of the compression spring between the rotating sleeve and the movable block so as to disengage the protruding portion at the lower portion of the rotating sleeve from the groove at the upper portion of the movable block. The rotating sleeve then rotates due to the force of the transverse extension spring between the outer sleeve and the rotating sleeve. The rotation of the rotating sleeve causes the protruding portion at the lower portion of the rotating sleeve to abut the upper portion of the movable block such that the movable block cannot move. Under the force of the spiral groove of the rotating sleeve, the reset button moves upward and protrudes from the housing of the three-phase moulded case circuit breaker, see FIG. 36. The short circuit actuating mechanism restores immediately after opening the circuit breaker, but the movable block cannot move due to the restraining force applied by the protruding portion of the rotating sleeve, which restrains the actuating arm of the short circuit actuating mechanism to prevent the actuating arm from restoring. The actuating arm of the short circuit actuating mechanism of the three-phase moulded case circuit breaker pushes the tripping linkage such that the circuit breaker cannot be closed, even if the handle is closed, which achieves self-locking upon occurrence of short circuit. Resetting is accomplished by pressing the button to force the reset button to move downward. Due to the spiral groove of the rotating sleeve, the rotating sleeve rotates by overcoming the force generated by the transverse extension spring between the outer sleeve and the rotating sleeve. When the protruding portion at the lower portion of the rotating sleeve rotates to the groove at the upper portion of the movable block, the movable block moves upward because the restoration force of the actuating arm of the short circuit actuating mechanism is much larger than the force of the compression spring between the rotating sleeve and the movable block. The actuating arm of the short circuit actuating mechanism can restore until the protruding portion at the lower portion of the rotating sleeve completely inserts into the groove at the upper portion of the movable block. After the trip link is restored, the circuit breaker may be closed by closing the handle again.

Figure 39:
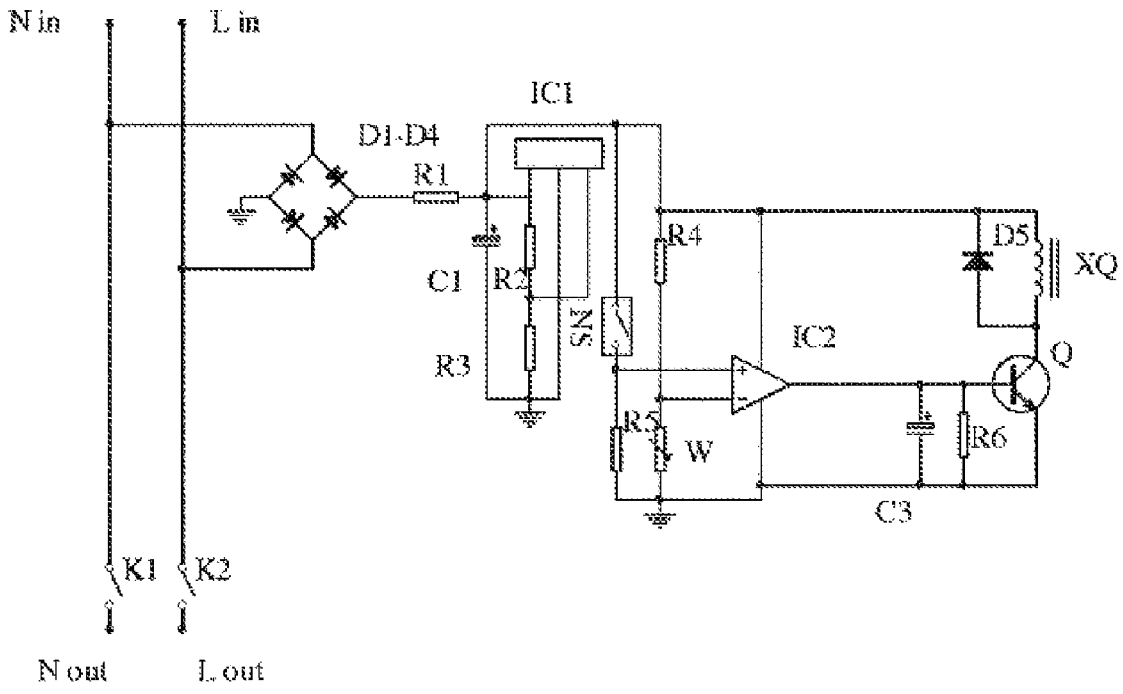
FIG. 39 is a circuit diagram illustrating an electromagnetic control circuit controlled by a reed pipe according to the present invention.

Referring to FIG. 39, the magnet control circuit controlled by a reed pipe according to the invention comprises a power supply circuit consisting of diodes D1-D4, resistances R1, R2, R3, capacitance C1, and an integrated circuit IC1, a comparison circuit consisting of resistances R4, R5, an alterable resistance W, and an integrated circuit IC2, a short circuit detecting circuit, including a reed pipe NS, and an output control circuit consisting of capacitance C3, resistance R6, triode Q, diode D5, and electromagnet coil XQ. When short circuit occurs, a large magnetic field will be generated around the conductors such that the reed pipe NS is conductive. A voltage is applied into an in-phase input end of the comparison circuit via the reed pipe and compared with a reference voltage of the reverse-phase input end of the comparison circuit. Subsequently, a high potential is output to drive the triode Q to conduct. The electromagnet acts to push the transmission mechanism to trip the circuit breaker, thereby cutting off the electrical source.

Figure 40:
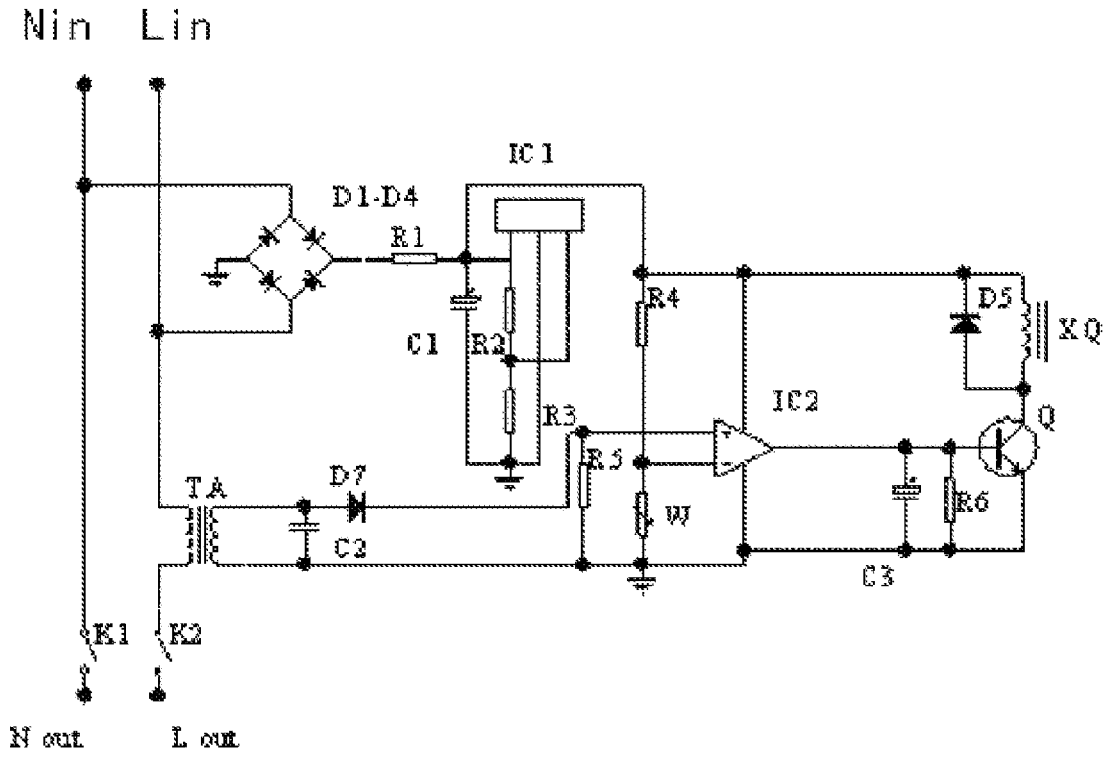
FIG. 40 is a circuit diagram illustrating an electromagnetic control circuit controlled by a transformer according to the present invention.

Referring to FIG. 40, the magnetic control circuit controlled by a transformer according to the invention comprises a power supply circuit consisting of diodes D1-D4, resistances R1, R2, R3, capacitance C1, and an integrated circuit IC1, a comparison circuit consisting of resistances R4, R5, an alterable resistance W, and an integrated circuit IC2, a short circuit detecting circuit, including a transformer TA, capacitance C2, diode D7, and an output control circuit consisting of capacitance C3, resistance R6, triode Q, diode D5, and electromagnet coil XQ. When short circuit occurs, a voltage induced by the transformer is input into an in-phase input end of the comparison circuit after being commutated by the diodes and compared with a reference voltage of the reverse-phase input end of the comparison circuit. Subsequently, a high potential is output to drive the triode Q to conduct. The electromagnet acts to push the transmission mechanism to trip the circuit breaker, thereby cutting off the electrical source.

Figure 41:
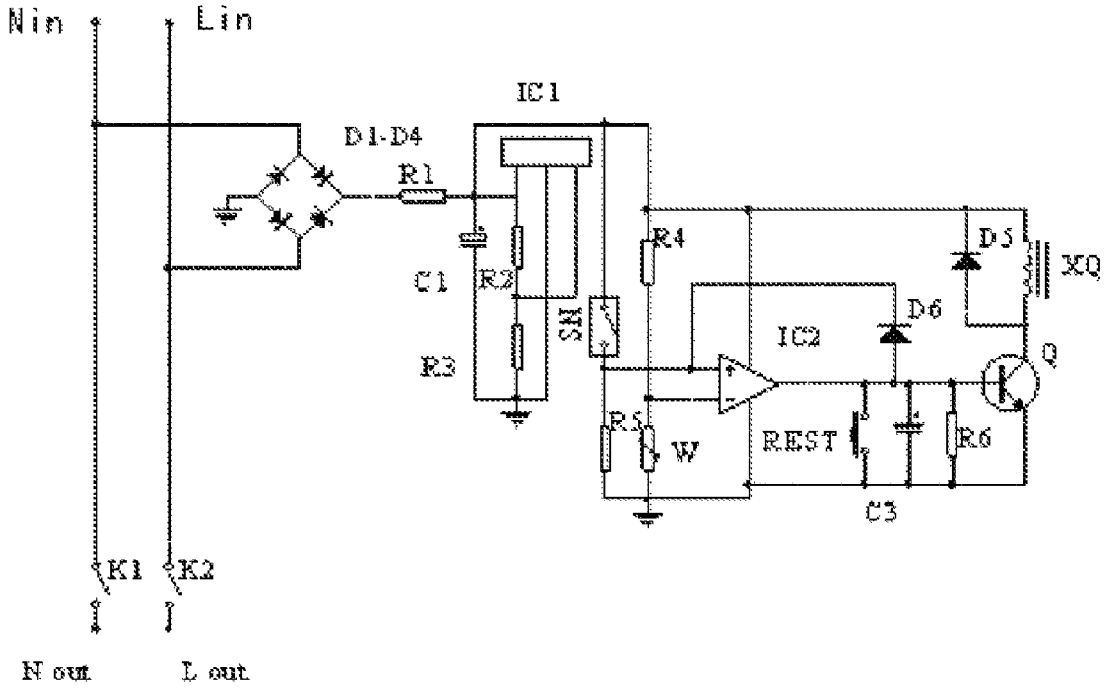
FIG. 41 is a circuit diagram illustrating a self-locking control circuit electrically controlled by a reed pipe according to the present invention.

Referring to FIG. 41, the self-locking control circuit electrically controlled by a reed pipe according to the invention comprises a power supply circuit consisting of diodes D1-D4, resistances R1, R2, R3, capacitance C1, and an integrated circuit IC1, a comparison circuit consisting of resistances R4, R5, an alterable resistance W, and an integrated circuit IC2, a short circuit detecting circuit, including a reed pipe NS, a self-locking circuit formed by diode D6, a resetting circuit formed by a micro switch REST and an output control circuit consisting of capacitance C3, resistance R6, triode Q, diode D5, and electromagnetic coil XQ. When short circuit occurs, a large magnetic field will be generated around the conductors such that the reed pipe NS is conductive. The voltage is input into an in-phase input end of the comparison circuit via the reed pipe and is compared with a reference voltage of the reverse-phase input end of the comparison circuit. Subsequently, a high potential is output to drive the triode Q to conduct and is fed to the in-phase input end of the comparison circuit via diode D6 to cause the circuit to self-lock so as to maintain the high potential. The electromagnet acts to push the transmission mechanism to trip the circuit breaker, thereby cutting off the electrical source. The circuit breaker cannot be reclosed until the microswitch REST is pressed down to reduce the output of the comparison circuit to a low potential, which cuts off the triode, thereby stopping the action of the electromagnet.

Figure 42:
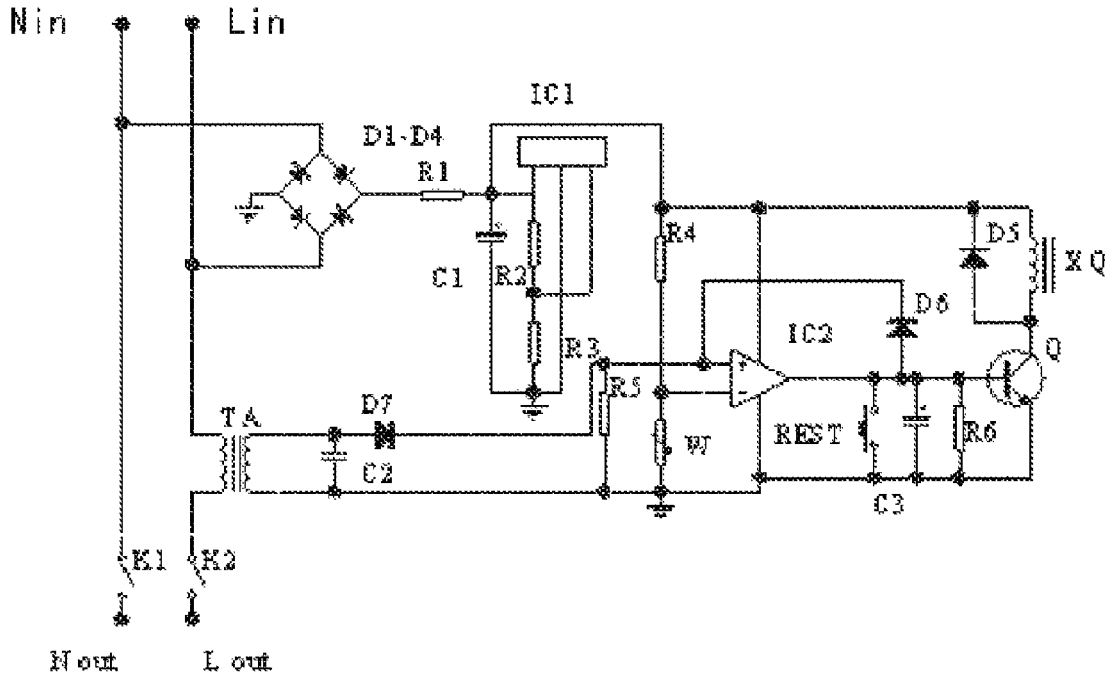
FIG. 42 is a circuit diagram illustrating a self-locking control circuit electrically controlled by a transformer according to the present invention.

Referring to FIG. 42, the self-locking control circuit electrically controlled by a transformer according to the invention comprises a power supply circuit consisting of diodes D1-D4, resistances R1, R2, R3, capacitance C1, and an integrated circuit IC1, a comparison circuit consisting of resistances R4, R5, an alterable resistance W, and an integrated circuit IC2, a short circuit detecting circuit, including a transformer TA, capacitance C2, and diode D7, a self-locking circuit formed by diode D6, a resetting circuit formed by a microswitch REST, and an output control circuit consisting of capacitance C3, resistance R6, triode Q, diode D5, and electromagnetic coil XQ. When short circuit occurs, a voltage induced by the transformer is input into an in-phase input end of the comparison circuit after being commutated by the diodes and compared with a reference voltage of the reversed-phase input end of the comparison circuit. Subsequently, a high potential is output to drive the triode Q to conduct and is fed to the in-phase input end of the comparison circuit via diode D6 to cause the circuit to self-lock so as to maintain the high potential. The electromagnet pushes the transmission mechanism, which trips the circuit breaker, thereby cutting off the electrical source. The circuit breaker cannot be reclosed until the microswitch REST is pressed down to reduce the output of the comparison circuit to a low potential, which cuts off the triode, thereby stopping the action of the electromagnet.

Figure 43:
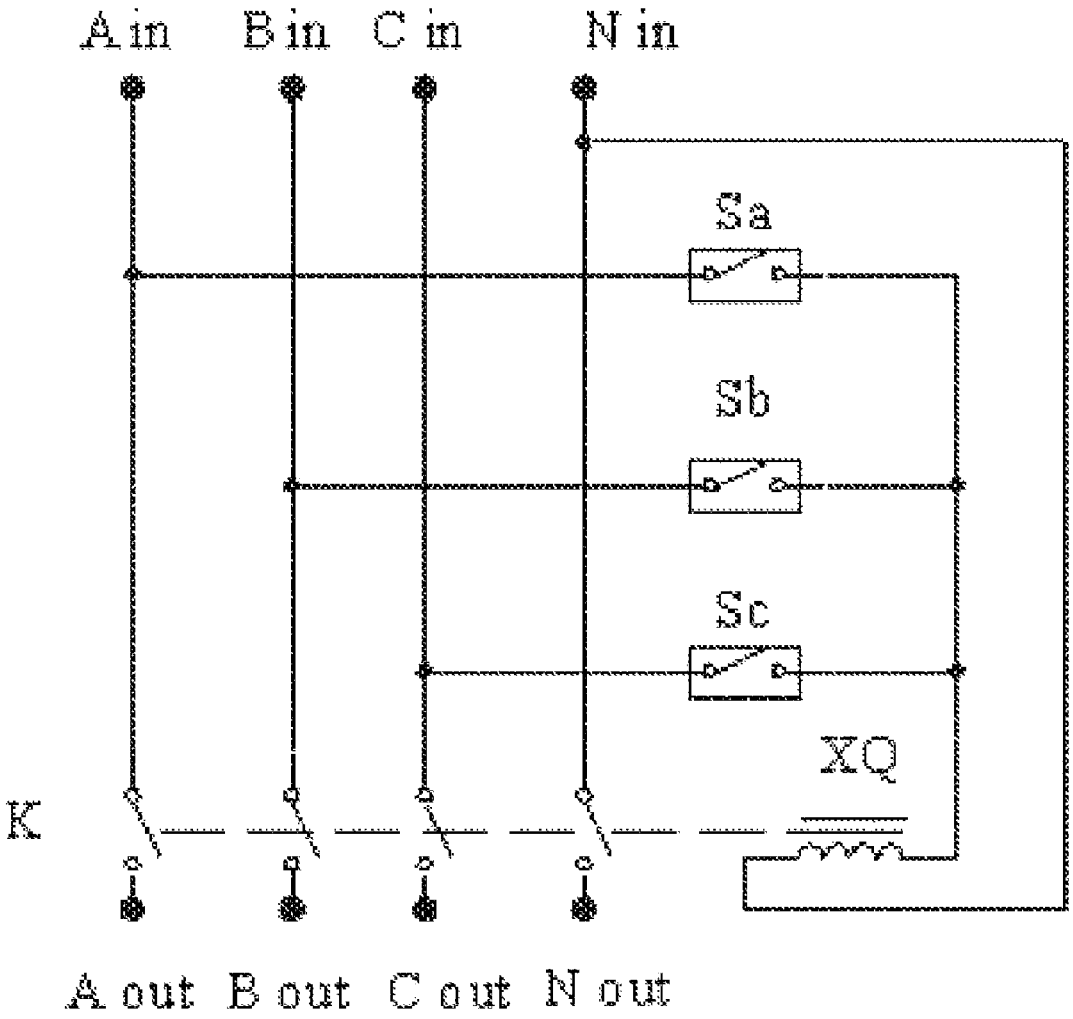
FIG. 43 is a circuit diagram illustrating an electromagnetic control circuit directly controlled by three-phase reed pipes according to the present invention.

Referring to FIG. 43, an electromagnet control circuit directly controlled by the three-phase reed pipes according to the present invention comprises three reed pipes and an electromagnet coil. One end of each of the reed pipes is connected with the input wires of a three-phase electrical source in the three-phase moulded case circuit breaker. The other ends are connected with each other, and the bundle is connected with the three-phase moulded case circuit breaker. When short circuit occurs in any one phase of the three-phase moulded case circuit breaker, the reed pipe of the phase will conduct to supply an electrical source to the electromagnetic coil so as to force the electromagnet to act.

Figure 44:
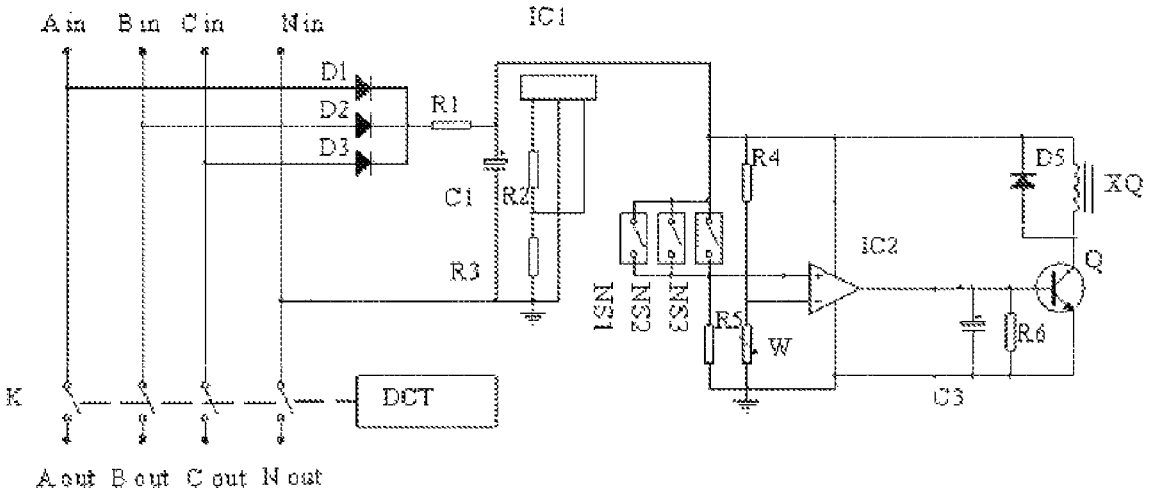
FIG. 44 is a circuit diagram illustrating an electromagnetic control circuit controlled by three-phase reed pipes according to the present invention.

Referring to FIG. 44, an electromagnet control circuit directly controlled by three-phase reed pipes according to the present invention comprises a power supply circuit consisting of diodes D1-D4, resistances R1, R2, R3, capacitance C1, and an integrated circuit IC1, a comparison circuit consisting of resistances R4, R5, an alterable resistance W, and an integrated circuit IC2, a short circuit detecting circuit, including a transformer TA, capacitance C2, diode D7, and an output control circuit consisting of capacitance C3, resistance R6, triode Q, diode D5, and electromagnetic coil XQ. When short circuit occurs, a voltage induced by the transformer is input into an in-phase input end of the comparison circuit after being commutated by the diodes and compared with a reference voltage of the reversed-phase input end of the comparison circuit. Subsequently, a high potential is output to drive the triode Q to conduct. The electromagnet acts to push the transmission mechanism to trip the circuit breaker, thereby cutting off the electrical source.

Referring to FIG. 45, a self-locking control circuit electrically controlled by three-phase reed pipes comprises a power supply circuit consisting of diodes D1-D4, resistances R1, R2, R3, capacitance C1, and an integrated circuit IC1, a comparison circuit consisting of resistances R4, R5, an alterable resistance W, and an integrated circuit IC2, a short circuit detecting circuit, including a transformer TA, capacitance C2, and diode D7, a self-locking circuit formed by diode D6, a resetting circuit formed by a microswitch REST, and an output control circuit consisting of capacitance C3, resistance R6, triode Q, diode D5, and electromagnetic coil XQ. When short circuit occurs, a voltage induced by the transformer is input into an in-phase input end of the comparison circuit after being commutated by the diodes and compared with a reference voltage of the reversed-phase input end of the comparison circuit. Subsequently, a high potential is output to drive the triode Q to conduct and is fed to the in-phase input end of the comparison circuit via diode D6 to cause the circuit to self-lock so as to maintain the high potential. The electromagnet pushes the transmission mechanism, which trips the circuit breaker, thereby breaking off the electrical source. The circuit breaker cannot be reclosed until the microswitch REST is pressed down to reduce the output of the comparison circuit to a low potential, which cuts off the triode, thereby stopping the action of the electromagnet.

The condition of a short circuit can be replaced by a routine overcurrent to achieve self-locking in the presence of an overcurrent such that the present invention can convert to a circuit breaker with a self-locking function in the presence of an overcurrent.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A circuit breaker comprising:

a housing;

a tripping linkage; and a short circuit self-locking mechanism, said short circuit self-locking mechanism comprising a self-locking mechanism and a reset mechanism comprising a button, said button having a compression spring and a convex block; wherein:

said self-locking mechanism comprises: a reed pipe; an electromagnet having a coil and an actuating arm; and a rotating rod having a groove;

said self-locking mechanism operates to keep said tripping linkage in a short circuit protection state;

said reset mechanism operates to enable said tripping linkage to restore an initial state;

said electromagnet and said reed pipe are disposed in said housing, and a lower end of said rotating rod is hinged in said housing;

said compression spring is disposed in said button and said button is engaged with said rotating rod;

said reed pipe is disposed in the vicinity of an inner lead of said circuit breaker;

said electromagnet is disposed in the vicinity of said rotating rod;

said coil is serially connected with said reed pipe and then with a power supply input to said circuit breaker;

said actuating arm is contacted with an edge of the top of a hinged point of said rotating rod, the other edge of said rotating rod is contacted with an upper portion of said tripping linkage;

said groove is disposed on an upper portion of said rotating rod;

said convex block is disposed at the lower portion of said button; and when said compression spring in said button is compressed, said convex block at the lower portion of said button is disposed in said groove on the upper portion of said rotating rod.

* * * * *